US011300320B2

(12) United States Patent
Ishikawa

(10) Patent No.: US 11,300,320 B2
(45) Date of Patent: Apr. 12, 2022

(54) AIR CONDITIONING INDOOR UNIT

(71) Applicant: Daikin Industries, LTD., Osaka (JP)

(72) Inventor: Shiori Ishikawa, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 16/648,098

(22) PCT Filed: Sep. 27, 2018

(86) PCT No.: PCT/JP2018/035992
§ 371 (c)(1),
(2) Date: Mar. 17, 2020

(87) PCT Pub. No.: WO2019/065858
PCT Pub. Date: Apr. 4, 2019

(65) Prior Publication Data

US 2020/0256584 A1 Aug. 13, 2020

(30) Foreign Application Priority Data

Sep. 27, 2017 (JP) ..... JP2017-186782

(51) Int. Cl.
*F24F 13/20* (2006.01)
*F24F 1/0057* (2019.01)
(Continued)

(52) U.S. Cl.
CPC ..... *F24F 13/20* (2013.01); *F24F 1/0011* (2013.01); *F24F 1/0057* (2019.02); *F24F 13/08* (2013.01); *F24F 1/0314* (2019.02)

(58) Field of Classification Search
CPC ..... F24F 13/20; F24F 1/0011; F24F 1/0057; F24F 13/08; F24F 1/0314
(Continued)

(56) References Cited

U.S. PATENT DOCUMENTS 5,807,170 A * 9/1998 Lee ..... F24F 1/0067 454/233
8,057,565 B2 * 11/2011 Yabu ..... F24F 1/0007 55/378
2008/0053131 A1 3/2008 Yasutomi et al.

FOREIGN PATENT DOCUMENTS

CN 101029753 A 9/2007
CN 103697537 A 4/2014
(Continued)

OTHER PUBLICATIONS

English translation of the International Preliminary Report on Patentability and Written Opinion of the International Searching Authority for Application No. PCT/JP2018/035992, dated Apr. 9, 2020.

(Continued)

*Primary Examiner* — Steven B McAllister
*Assistant Examiner* — Benjamin W Johnson
(74) *Attorney, Agent, or Firm* — Birch, Stewart, Kolasch & Birch, LLP

(57) ABSTRACT

It is an object of the invention to provide an air conditioning indoor unit having suppressed change in size in a front view between before and after panel motion as well as having simplified and excellent appearance. An air conditioning indoor unit (1) includes a first panel (111) positioned in a lower side and configured to shift to open a front end of a front blow-in port (4B). The first panel (111) and the second panel (112) are positioned inside a product contour in a front view, or are exposed slightly even when being exposed from the product contour. This configuration has less mounting restriction and achieves excellent appearance.

20 Claims, 23 Drawing Sheets

(51) Int. Cl.
*F24F 1/0011* (2019.01)
*F24F 13/08* (2006.01)
*F24F 1/0314* (2019.01)

(58) Field of Classification Search
USPC ..... 454/233
See application file for complete search history.

(56) References Cited

FOREIGN PATENT DOCUMENTS

| | | | |
|---|---|---|---|
| EP | 2 327 938 | A1 | 6/2011 |
| JP | 2005-98683 | A | 4/2005 |
| JP | 2006-52937 | A | 2/2006 |
| JP | 2009-127979 | A | 6/2009 |
| JP | 2011-163703 | A | 8/2011 |
| JP | 2013-122326 | A | 6/2013 |
| WO | WO 2014/199590 | A1 | 12/2014 |

OTHER PUBLICATIONS

International Search Report and English translation for Application No. PCT/JP2018/035992, dated Oct. 30, 2018.
Extended European Search Report dated Oct. 1, 2020 in corresponding European Application No. 18861522.3.

* cited by examiner

AIR CONDITIONING INDOOR UNIT

TECHNICAL FIELD

The present invention relates to an air conditioning indoor unit.

BACKGROUND ART

There have been widely spread air conditioning indoor units including a panel configured to cover a front surface of an indoor unit body and close a blow-out port when the air conditioning indoor unit is not in operation and shift to open the blow-out port when the air conditioning indoor unit is in operation.

For example, Patent Literature 1 (JP 2005-98683 A) discloses an indoor unit depicted in FIG. 10 and including a front panel that is configured to keep a vertical posture and shift obliquely forward and upward to open a blow-out port and a front blow-in port.

SUMMARY OF THE INVENTION

Technical Problem

Such an indoor unit depicted in FIG. 10 of Patent Literature 1 has change in product contour in a front view between a case where the indoor unit is in operation and a case where the indoor unit is not in operation, and thus has strict mounting restriction. The indoor unit has difficulty particularly when mounted at a position close to a ceiling.

In view of this, it is an object of the present invention to provide an air conditioning indoor unit having suppressed change in size in a front view between before and after panel motion.

Solutions to Problem

An air conditioning indoor unit according to a first aspect of the present invention includes an indoor unit body having a front surface provided with a blow-in port, and a front panel. The front panel covers the front surface of the indoor unit body, and is configured to at least partially shift to open and close the blow-in port. The front panel includes a first panel positioned in a lower side, and a second panel positioned above the first panel. The first panel shifts to be positioned in front of the second panel to open the blow-in port.

The air conditioning indoor unit includes the first panel positioned in the lower side and configured to shift to open a front end of the blow-in port. The first panel and the second panel are positioned inside a product contour in a front view, or are exposed slightly even when being exposed from the product contour. This configuration has less mounting restriction and achieves excellent appearance.

An air conditioning indoor unit according to a second aspect of the present invention is the air conditioning indoor unit according to the first aspect, in which, when the air conditioning indoor unit is not in operation, the first panel and the second panel have surfaces aligned on an identical vertical plane including the front surface of the indoor unit body.

The first panel and the second panel constitute the identical plane to achieve excellent appearance of the air conditioning indoor unit.

An air conditioning indoor unit according to a third aspect of the present invention is the air conditioning indoor unit according to the first or second aspect, in which the indoor unit body has a lower portion provided with a blow-out port. The first panel shifts to open at least part of the blow-out port.

The air conditioning indoor unit has a simplified mechanism with no need to shift two panels.

An air conditioning indoor unit according to a fourth aspect of the present invention is the air conditioning indoor unit according to any one of the first to third aspects, in which the first panel is vertically longer than the second panel in a front view.

When the lower first panel shifts to be positioned ahead of the upper second panel, the second panel is hidden by the first panel in a front view to achieve excellent appearance of the air conditioning indoor unit.

An air conditioning indoor unit according to a fifth aspect of the present invention is the air conditioning indoor unit according to any one of the first to fourth aspects, in which the indoor unit body has a lower portion provided with a blow-out port. The second panel has a vertical length set to be equal to or more than a height of the blow-out port.

The vertical length of the upper second panel is at least equal to the height of the blow-out port in the air conditioning indoor unit, so that the blow-out port has a front end opened if the first panel shifts to be positioned ahead of the second panel until an upper end of the first panel is leveled with an upper end of the second panel in a front view.

An air conditioning indoor unit according to a sixth aspect of the present invention is the air conditioning indoor unit according to any one of the first to fifth aspects, in which the indoor unit body has a lower portion provided with a blow-out port. The first panel has a vertical length set to be equal to or more than a height of the blow-out port.

The vertical length of the lower first panel is at least equal to the height of the blow-out port in the air conditioning indoor unit, so that the blow-out port has a front end opened if the first panel shifts to be positioned ahead of the second panel until an upper end of the first panel is leveled with an upper end of the second panel in a front view.

An air conditioning indoor unit according to a seventh aspect of the present invention is the air conditioning indoor unit according to any one of the first to sixth aspects, in which the first panel ascends to have an upper end at least leveled with an upper end of the second panel in a front view.

The second panel is entirely covered with the first panel in a front view to achieve excellent appearance of the air conditioning indoor unit.

An air conditioning indoor unit according to an eighth aspect of the present invention is the air conditioning indoor unit according to any one of the first to seventh aspects, in which the first panel shifts obliquely upward.

The first panel shifts obliquely upward to quickly open the blow-out port in the air conditioning indoor unit.

An air conditioning indoor unit according to a ninth aspect of the present invention is the air conditioning indoor unit according to any one of the first to eighth aspects, in which an upper end of the first panel and a lower end of the second panel face each other and are inclined forward and upward.

The upper end of the first panel and the lower end of the second panel face each other and are inclined forward and upward. The air conditioning indoor unit accordingly inhibits interference between the panels when the first panel shifts obliquely upward.

An air conditioning indoor unit according to a tenth aspect of the present invention is the air conditioning indoor unit according to any one of the first to ninth aspects, and the air conditioning indoor unit further includes an arm. The arm turns to shift the first panel. The arm has a shaft provided behind the second panel.

The arm lifts the first panel to be positioned above the shaft, to shift the first panel to be positioned in front of the second panel in the air conditioning indoor unit.

An air conditioning indoor unit according to an eleventh aspect of the present invention is the air conditioning indoor unit according to the tenth aspect, in which the arm has a connecting portion. The connecting portion is connected to the first panel. The arm turns until the connecting portion is positioned in front of the second panel.

The arm and the second panel do not interfere with each other in the air conditioning indoor unit even when the arm lifts the first panel to be positioned in front of the second panel.

Advantageous Effects of Invention

The air conditioning indoor unit according to the first aspect of the present invention includes the first panel positioned in the lower side and configured to shift to open the front end of the blow-in port. The first panel and the second panel are positioned inside the product contour in a front view, or are exposed slightly even when being exposed from the product contour. This configuration has less mounting restriction and achieves excellent appearance.

In the air conditioning indoor unit according to the second aspect of the present invention, the first panel and the second panel constitute the identical plane to achieve excellent appearance.

The air conditioning indoor unit according to the third aspect of the present invention has a simplified mechanism with no need to shift two panels.

When the lower first panel shifts to be positioned ahead of the upper second panel in the air conditioning indoor unit according to the fourth aspect of the present invention, the second panel is hidden by the first panel in a front view to achieve excellent appearance.

The vertical length of the upper second panel is at least equal to the height of the blow-out port in the air conditioning indoor unit according to the fifth aspect of the present invention, so that the front end of the blow-out port is opened if the first panel shifts to be positioned ahead of the second panel until the upper end of the first panel is leveled with the upper end of the second panel in a front view.

The vertical length of the lower first panel is at least equal to the height of the blow-out port in the air conditioning indoor unit according to the sixth aspect of the present invention, so that the front end of the blow-out port is opened if the first panel shifts to be positioned ahead of the second panel until the upper end of the first panel is leveled with the upper end of the second panel in a front view.

In the air conditioning indoor unit according to the seventh aspect of the present invention, the second panel is entirely covered with the first panel in a front view to achieve excellent appearance.

In the air conditioning indoor unit according to the eighth aspect of the present invention, the first panel shifts obliquely upward to quickly open the blow-out port.

In the air conditioning indoor unit according to the ninth aspect of the present invention, the upper end of the first panel and the lower end of the second panel face each other and are inclined forward and upward. The air conditioning indoor unit accordingly inhibits interference between the panels when the first panel shifts obliquely upward.

In the air conditioning indoor unit according to the tenth aspect of the present invention, the arm lifts the first panel to be positioned above the shaft, to shift the first panel to be positioned in front of the second panel.

In the air conditioning indoor unit according to the eleventh aspect of the present invention, the arm and the second panel do not interfere with each other even when the arm lifts the first panel to be positioned in front of the second panel.

DESCRIPTION OF EMBODIMENTS

An embodiment of the present invention will be described hereinafter with reference to the drawings. The following embodiment specifically exemplifies the present invention and is not intended to limit the technical scope of the present invention.

(1) Outline of Air Conditioning Indoor Unit 1

Figure 1A:
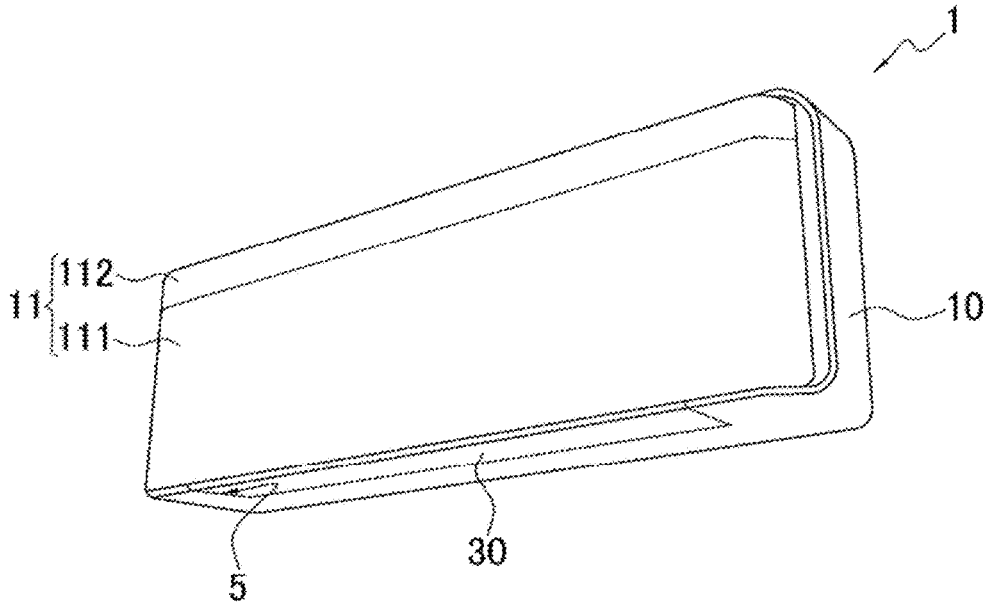
FIG. 1A is a perspective view of an air conditioning indoor unit not in operation.
Figure 1B:
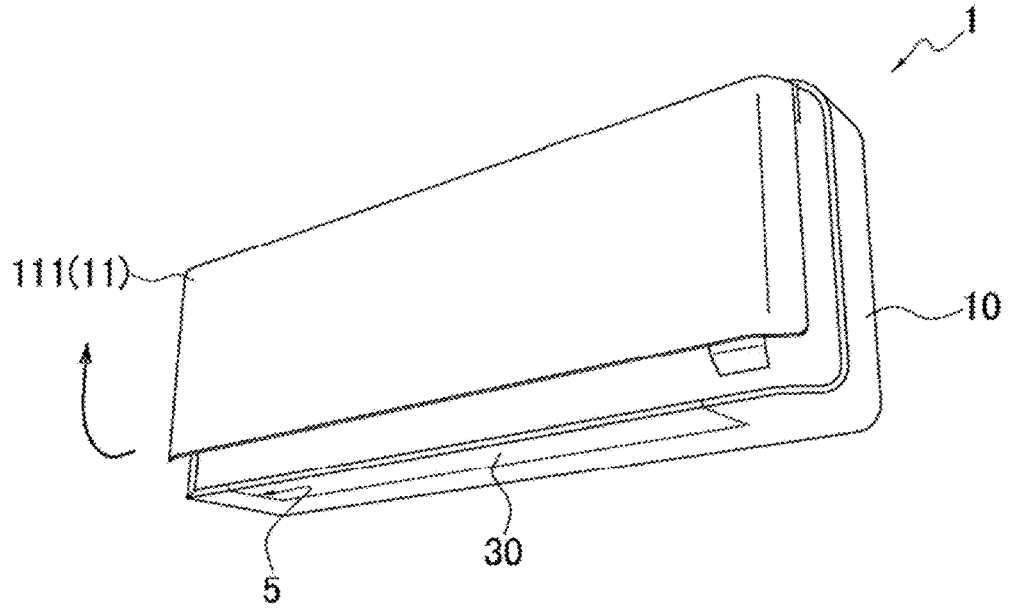
FIG. 1B is a perspective view of the air conditioning indoor unit in preparation for operation.
Figure 2A:
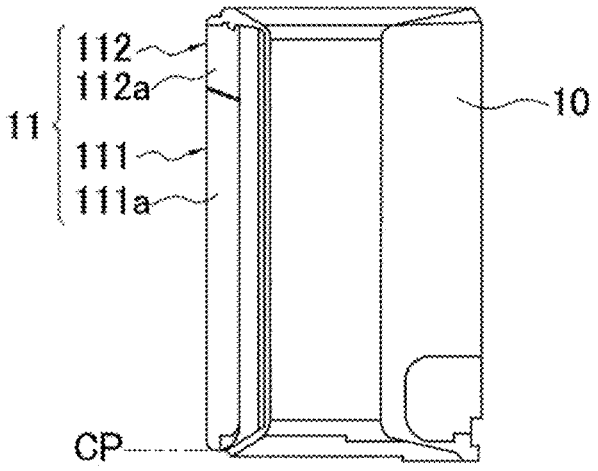
FIG. 2A is a side view of the air conditioning indoor unit not in operation.
Figure 2B:
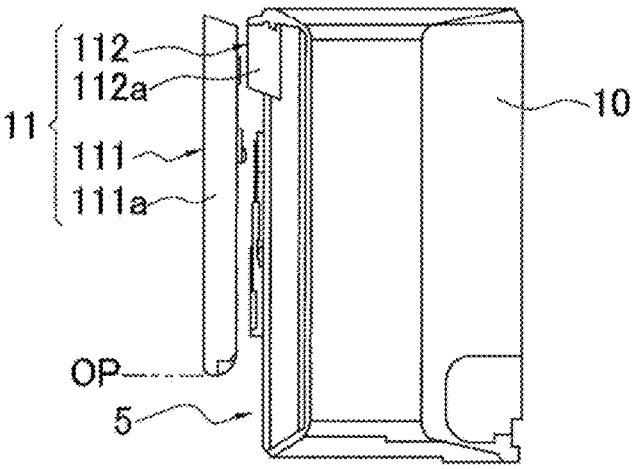
FIG. 2B is a side view of the air conditioning indoor unit in preparation for operation.
Figure 3:
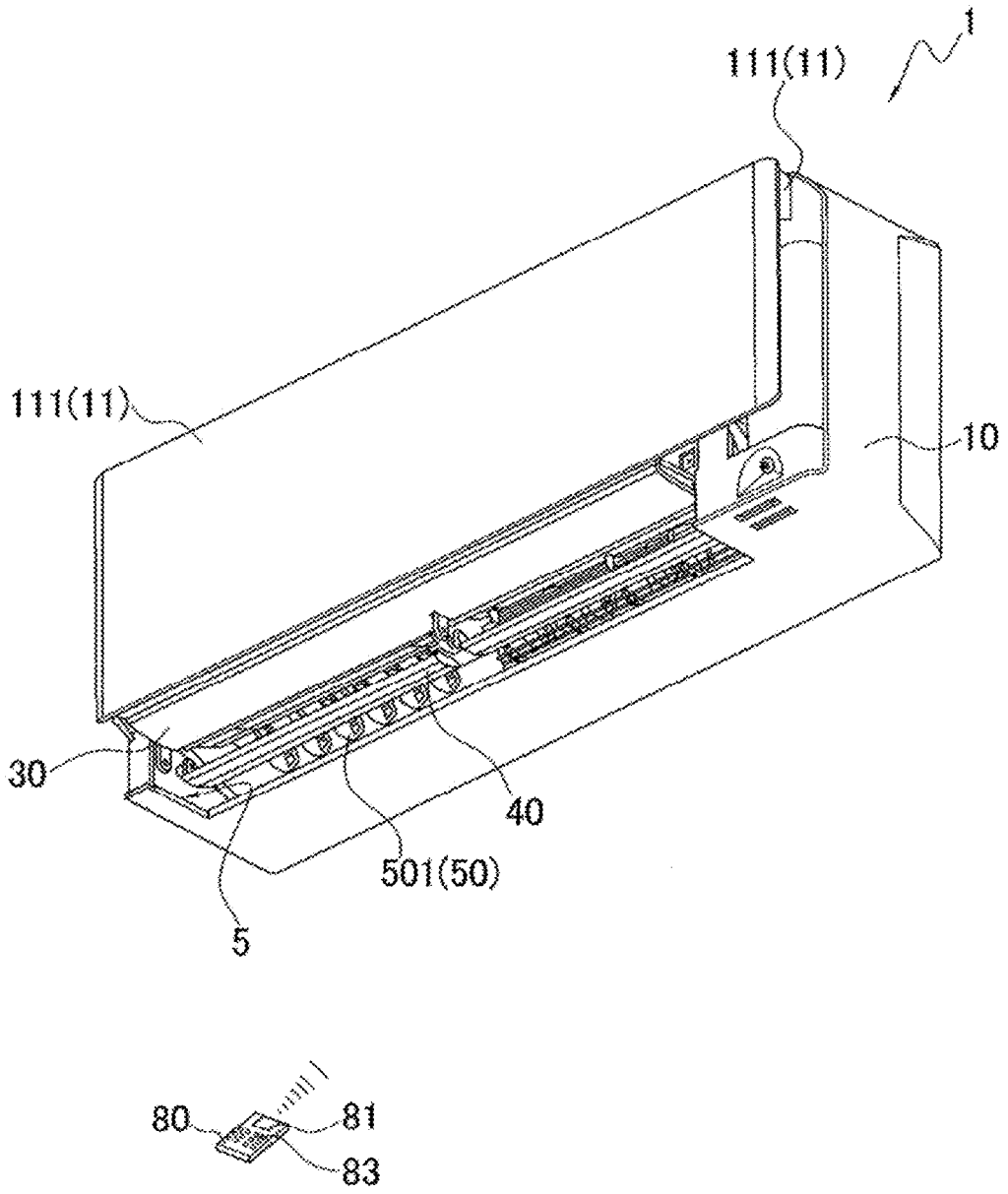
FIG. 3 is a perspective view of the air conditioning indoor unit in operation.

FIG. 1A is a perspective view of an air conditioning indoor unit 1 not in operation. FIG. 1B is a perspective view of the air conditioning indoor unit 1 in preparation for operation. FIG. 2A is a side view of the air conditioning indoor unit 1 not in operation. FIG. 2B is a side view of the air conditioning indoor unit 1 in preparation for operation. FIG. 3 is a perspective view of the air conditioning indoor unit 1 in operation. The air conditioning indoor unit 1 depicted in FIG. 1A, FIG. 1B, FIG. 2A, FIG. 2B, and FIG. 3 is of a wall-hung type, and includes an indoor unit body 10 and a front panel 11 covering a front surface of the indoor unit body 10.

As depicted in FIG. 1A and FIG. 2A, the air conditioning indoor unit 1 not in operation includes a blow-out port 5 having a front end entirely covered with a first panel 111 and a lower end entirely covered with a first airflow direction adjusting blade 30. This configuration does not allow the interior of the indoor unit body 10 to be visible via the blow-out port 5 to achieve excellent design.

As depicted in FIG. 1B and FIG. 2B, the first panel 111 in the front panel 11 shifts forward an upward to be disposed in front of a second panel 112 before the air conditioning indoor unit 1 starts operation, to allow the blow-out port 5 to be opened forward. As depicted in FIG. 3, the first airflow direction adjusting blade 30 positioned at the bottom of the indoor unit body 10 subsequently turns clockwise by 180 degrees to open the lower end of the blow-out port 5.

(2) Indoor Unit Body 10

Figure 4:
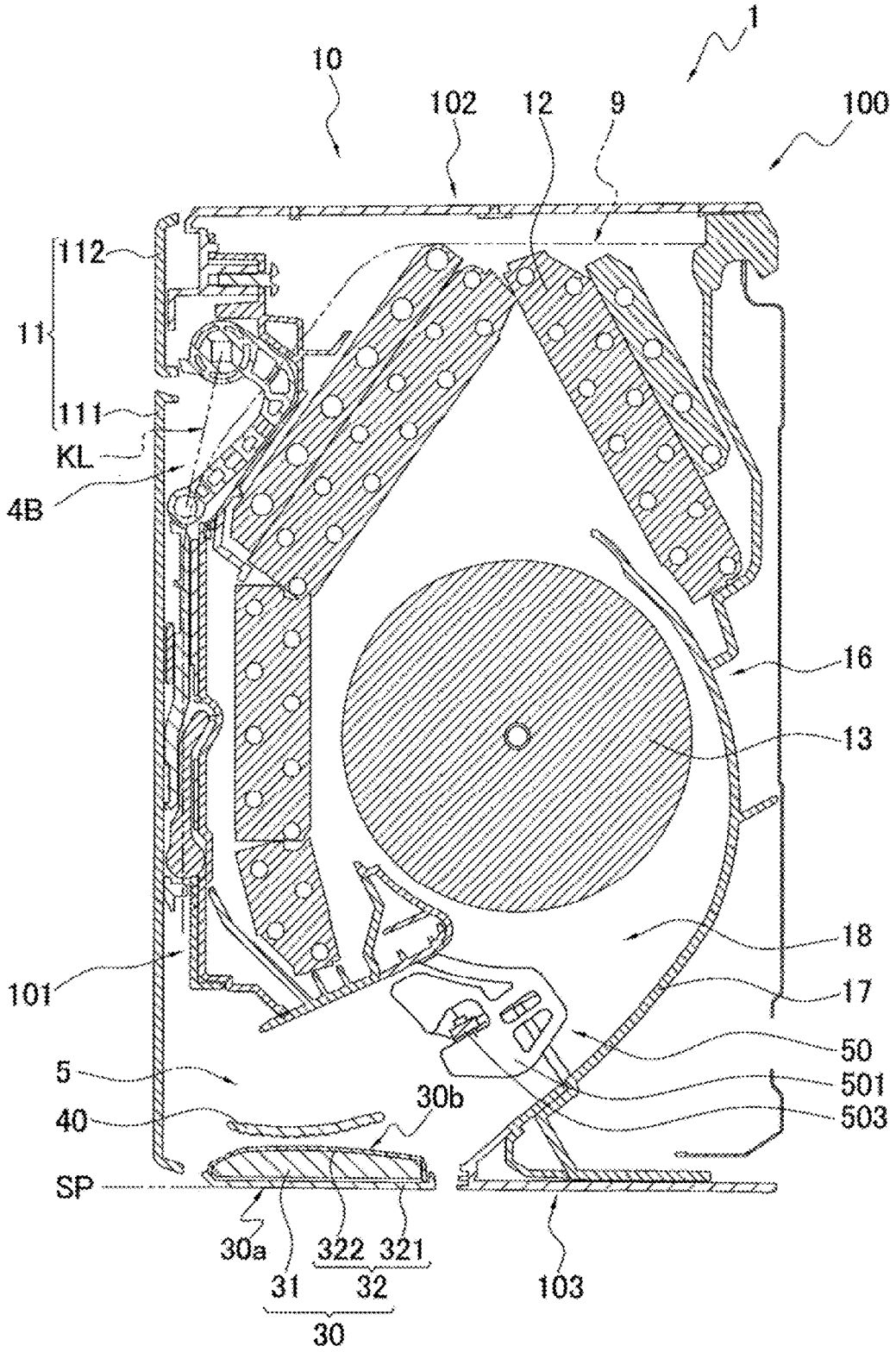
FIG. 4 is a longitudinal sectional view of the air conditioning indoor unit not in operation.
Figure 5:
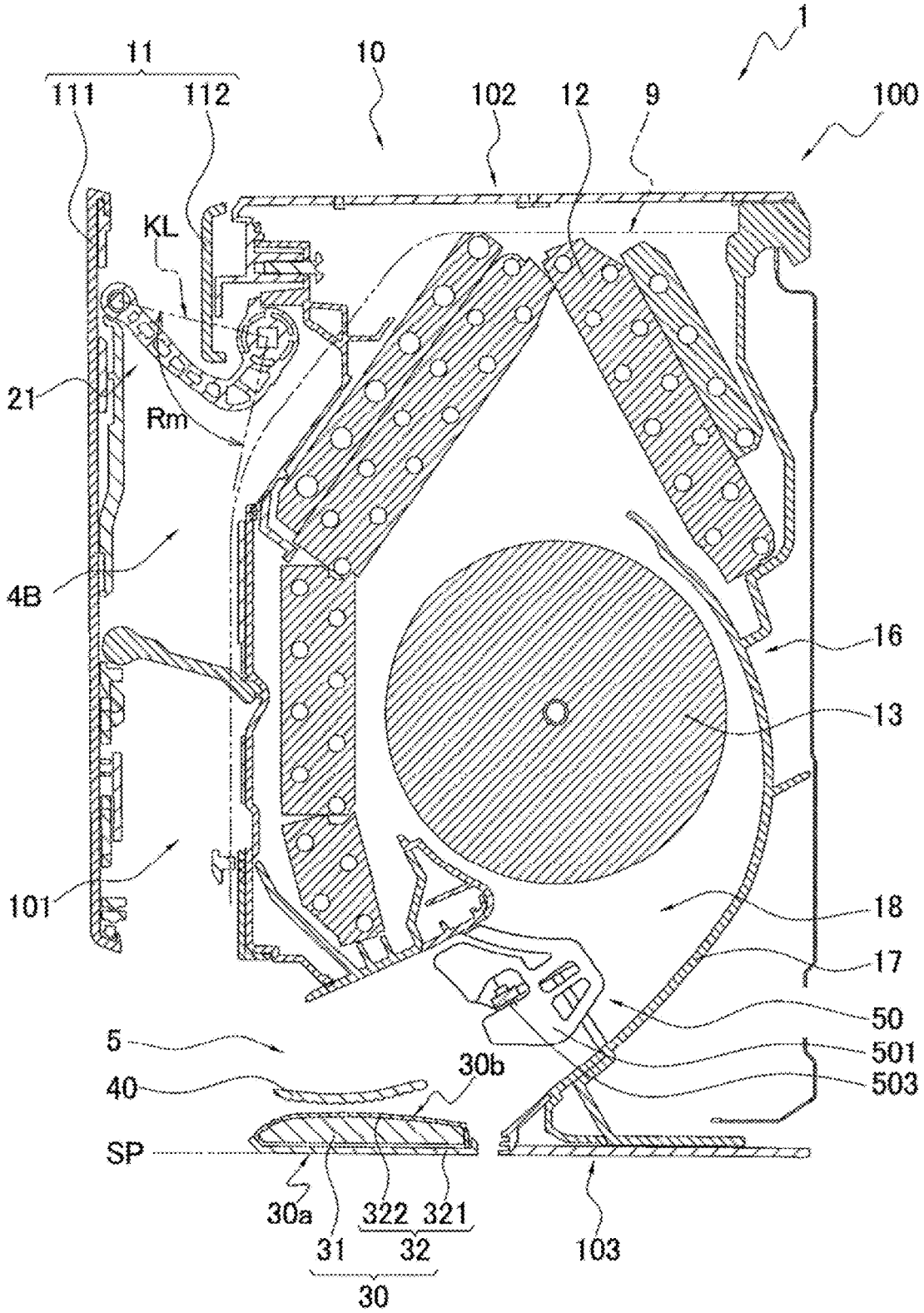
FIG. 5 is a longitudinal sectional view of the air conditioning indoor unit in preparation for operation.
Figure 6:
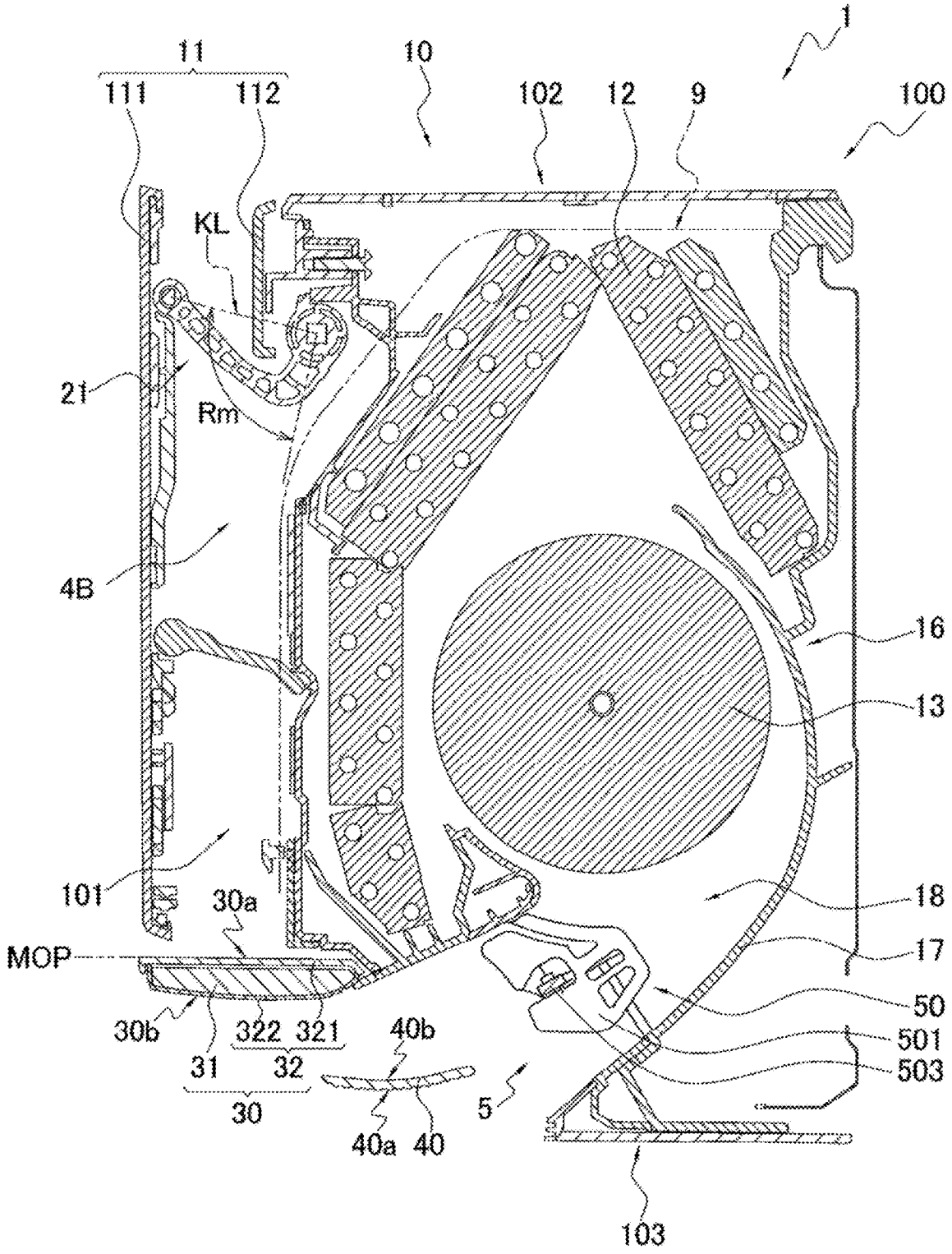
FIG. 6 is a longitudinal sectional view of the air conditioning indoor unit in operation.

FIG. 4 is a longitudinal sectional view of the air conditioning indoor unit 1 not in operation. FIG. 5 is a longitudinal sectional view of the air conditioning indoor unit 1 in preparation for operation. FIG. 6 is a longitudinal sectional view of the air conditioning indoor unit 1 in operation. As depicted in FIG. 4, FIG. 5, and FIG. 6, the indoor unit body 10 includes a body casing 100 constituting an outer contour, as well as the first airflow direction adjusting blade 30, a second airflow direction adjusting blade 40, and a perpendicular airflow direction adjusting blade 50 that are configured to adjust a blow-out direction of conditioned air. The body casing 100 accommodates an indoor heat exchanger 12, a fan 13, and a frame 16.

(2-1) Body Casing 100

The body casing 100 has a front surface 101, an upper surface 102, and a lower surface 103, which form a substantially rectangular parallelepiped space accommodating the indoor heat exchanger 12, the fan 13, the frame 16, and a filter 9. The upper surface 102 is provided with an upper blow-in port 4A (see FIG. 10) including a plurality of slits. The blow-out port 5 extends from a lower portion of the front surface 101 to a front portion of the lower surface 103. The front surface 101 further includes a front blow-in port 4B disposed above the blow-out port 5.

The indoor heat exchanger 12 and the fan 13 are attached to the frame 16. The indoor heat exchanger 12 exchanges heat with passing air. The fan 13 causes air introduced via the upper blow-in port 4A and the front blow-in port 4B to reach and pass through the indoor heat exchanger 12 and then blow out of the blow-out port 5. The blow-out port 5 is provided with the first airflow direction adjusting blade 30 and the second airflow direction adjusting blade 40 configured to guide blow-out air in a vertical direction. The first airflow direction adjusting blade 30 is driven by a motor (not depicted) and is configured to change an air blow-out direction as well as open and close the blow-out port 5 adjacent to the lower surface 103.

The perpendicular airflow direction adjusting blade 50 is provided upstream of the first airflow direction adjusting blade 30 and the second airflow direction adjusting blade 40, and is configured to guide air in a lateral direction.

The filter 9 is disposed between the indoor heat exchanger 12 and the front surface 101 as well as the upper surface 102 of the body casing 100. The filter 9 removes dust contained in air flowing in toward the indoor heat exchanger 12.

The fan 13 operates to cause indoor air to flow via the upper blow-in port 4A, the front blow-in port 4B, the filter 9, and the indoor heat exchanger 12, be sucked into the fan 13, and then blow out of the blow-out port 5 via a blow-out flow path 18.

(2-2) First Airflow Direction Adjusting Blade 30

The first airflow direction adjusting blade 30 is positioned still to cover the lower end of the blow-out port 5 when the air conditioning indoor unit is not in operation. Such a position of the first airflow direction adjusting blade 30 will be called an initial position SP (see FIG. 4 and FIG. 5). The first airflow direction adjusting blade 30 located at the initial position SP has a lower surface that is constantly visible while the air conditioning indoor unit is not in operation and is thus finished to have excellent appearance. The lower surface will be called a decorative surface 30*a*.

At the initial position SP, the blow-out port 5 has an inner surface that is directed downward and is followed by blow-out air when the air conditioning indoor unit is in operation. The inner surface will be called a Coanda surface 30*b*.

The first airflow direction adjusting blade 30 is turned by a motor (not depicted). The first airflow direction adjusting blade 30 has a shaft (not depicted) positioned above the front end of the first airflow direction adjusting blade 30 located at the initial position SP by about a half of a height of the blow-out port 5.

As depicted in FIG. 6, the first airflow direction adjusting blade 30 rotated clockwise by 180 degrees projects forward from the upper end of the blow-out port 5 with the decorative surface 30*a* directed being upward and the Coanda surface 30*b* being directed downward.

The first airflow direction adjusting blade 30 will be described in detail later in a section "(5) Detailed description of first airflow direction adjusting blade 30".

(2-3) Second Airflow Direction Adjusting Blade 40

The second airflow direction adjusting blade 40 is positioned upstream of the blow-out port 5 and above the initial position SP of the first airflow direction adjusting blade 30 when the air conditioning indoor unit is not in operation. As depicted in FIG. 6, the second airflow direction adjusting blade 40 has an arc sectional shape having a convex surface

40*a* directed downward and a concave surface 40*b* directed upward during cooling operation. In order to generate a vertically downward air flow during heating operation, the second airflow direction adjusting blade 40 may be postured to have the convex surface 40*a* directed upward and the concave surface 40*b* directed downward.

The second airflow direction adjusting blade 40 is turned by a motor (not depicted). The second airflow direction adjusting blade 40 has a shaft (not depicted) positioned above the concave surface 40*b*.

The second airflow direction adjusting blade 40 will be described in detail later in a section "(6) Detailed description of second airflow direction adjusting blade 40".

(2-4) Perpendicular Airflow Direction Adjusting Blade 50

As depicted in FIG. 4, FIG. 5, and FIG. 6, the perpendicular airflow direction adjusting blade 50 includes a plurality of blade pieces 501 and a coupling rod 503 coupling the plurality of blade pieces 501. At the blow-out flow path 18, the perpendicular airflow direction adjusting blade 50 is positioned closer to the fan 13 in comparison to the first airflow direction adjusting blade 30 and the second airflow direction adjusting blade 40.

When the coupling rod 503 horizontally reciprocates in the longitudinal direction of the blow-out port 5, the plurality of blade pieces 501 laterally swings from a state perpendicular to the longitudinal direction. The coupling rod 503 is horizontally reciprocated by a motor (not depicted).

(3) Front Panel 11

As depicted in FIG. 1A, FIG. 2A, and FIG. 4, the front panel 11 covers the front surface of the indoor unit body 10. The front panel 11 is divided into upper and lower portions, and includes the first panel 111 as the lower portion and the second panel 112 positioned above the first panel 111.

The first panel 111 and the second panel 112 constitute a design surface of the air conditioning indoor unit 1, and are similar to each other in pattern, color, or combination thereof.

The first panel 111 has different positioning between the case where the air conditioning indoor unit 1 is not in operation and the case where the air conditioning indoor unit 1 is in operation.

In a first case where the air conditioning indoor unit 1 is not in operation, the first panel 111 and the second panel 112 have surfaces vertically aligned on an identical vertical plane to be beautifully integrated to each other and achieve excellent appearance. The first panel 111 is set to be vertically longer than the second panel 112 in a front view. The second panel 112 has a vertical length set to be equal to a height of the front end of the blow-out port 5.

The first panel 111 and the blow-out port 5 have lower ends adjacent to each other as if the lower ends seem to be leveled in a front view. Similarly, the second panel 112 and the front surface 101 of the body casing 100 have upper ends adjacent to each other as if the upper ends seem to be leveled in a front view.

In a second case where the air conditioning indoor unit 1 starts operation, a panel conveyance mechanism 21 shifts forward and upward simultaneously the first panel 111 and shifts the first panel 111 until the upper end of the first panel 111 is leveled with the upper end of the second panel 112 in a front view. The front end of the blow-out port 5 is thus opened, and the front blow-in port 4B and the first panel 111 form a space for air introduction.

When the first panel 111 and the second panel 112 have the upper ends leveled with each other, the front panel 11 does not project upward from a top surface of the indoor unit body 10 when the air conditioning indoor unit is in operation without change in size of a product between the case where the air conditioning indoor unit is in operation and the case where the air conditioning indoor unit is not in operation in a front view.

Even in a case where a room ceiling surface and the upper surface of the air conditioning indoor unit 1 have distance restriction, a service person can mount the air conditioning indoor unit without paying attention to size of the product in operation. The upper end of the first panel 111 and the upper end of the second panel 112 do not need to be completely leveled in a front view, and have only to be adjacent to each other so as to seem to be leveled in the front view. The upper end of the first panel 111 can thus project slightly from the upper end of the second panel 112 in the front view.

As depicted in FIG. 2A and FIG. 2B, the upper end of a side surface 111*a* of the first panel 111 and the lower end of a side surface 112*a* of the second panel 112 face each other and are inclined forward and upward. Even when the first panel 111 shifts forward and upward simultaneously, the upper end of the side surface 111*a* of the first panel 111 and the lower end of the side surface 112*a* of the second panel 112 will not interfere with each other.

(3-1) Panel Conveyance Mechanism 21

The panel conveyance mechanism 21 is configured to cause the first panel 111 to shift forward and upward simultaneously, in other words, shift obliquely upward. For easier description, assume that the first panel 111 closes the front end of the blow-out port 5 at a close position CP (see FIG. 2A), and that the first panel 111 shifts vertically to have the upper end leveled with the upper end of the second panel 112 in a front view and opens the front end of the blow-out port 5 at an open position OP (see FIG. 2B).

Figure 7:
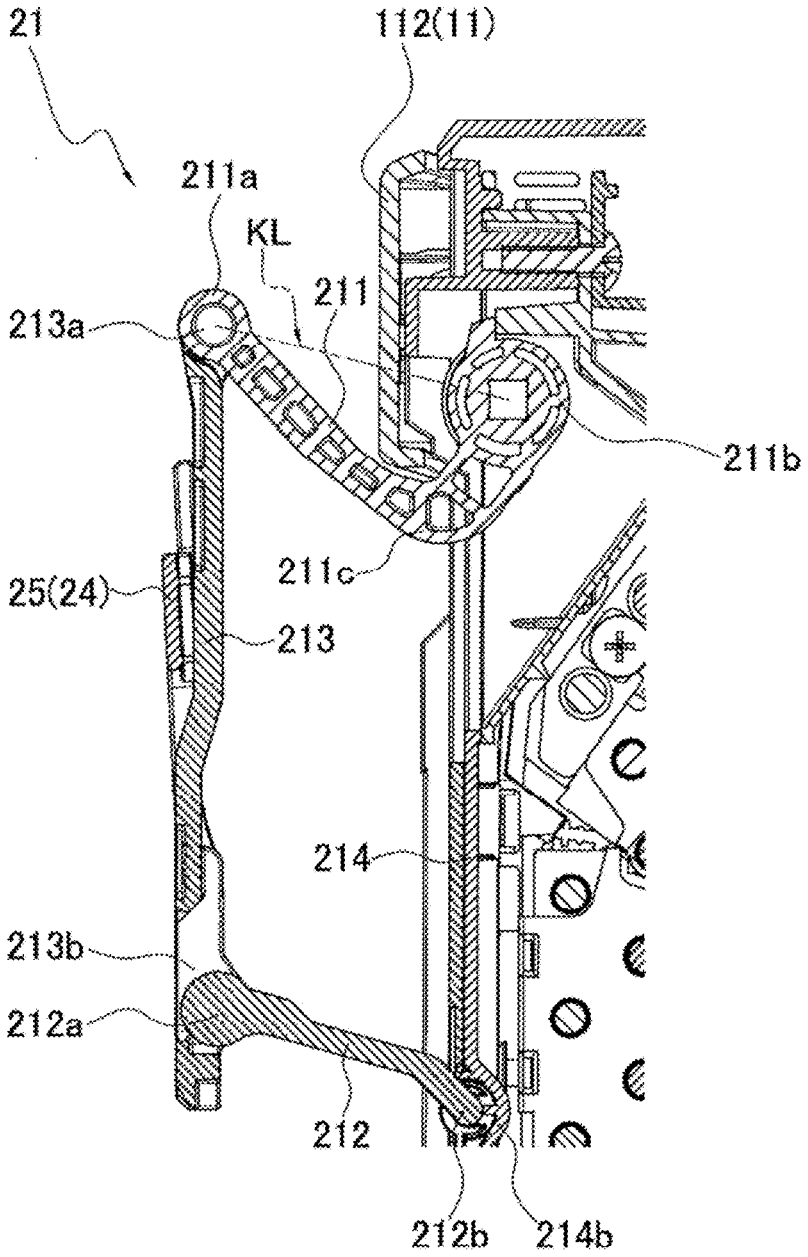
FIG. 7 is a longitudinal sectional view of a panel conveyance mechanism.
Figure 11A:
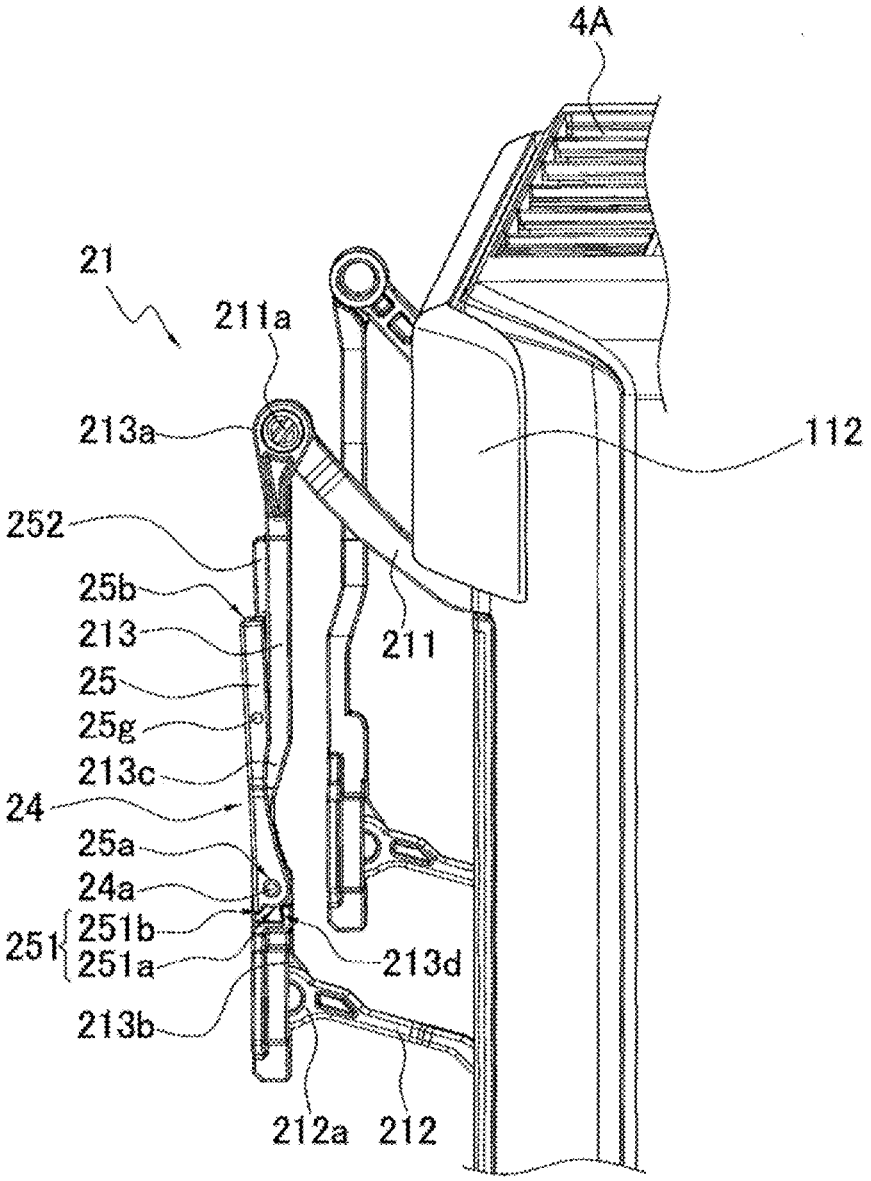
FIG. 11A is a perspective view of a panel support mechanism before a support operates.
Figure 11B:
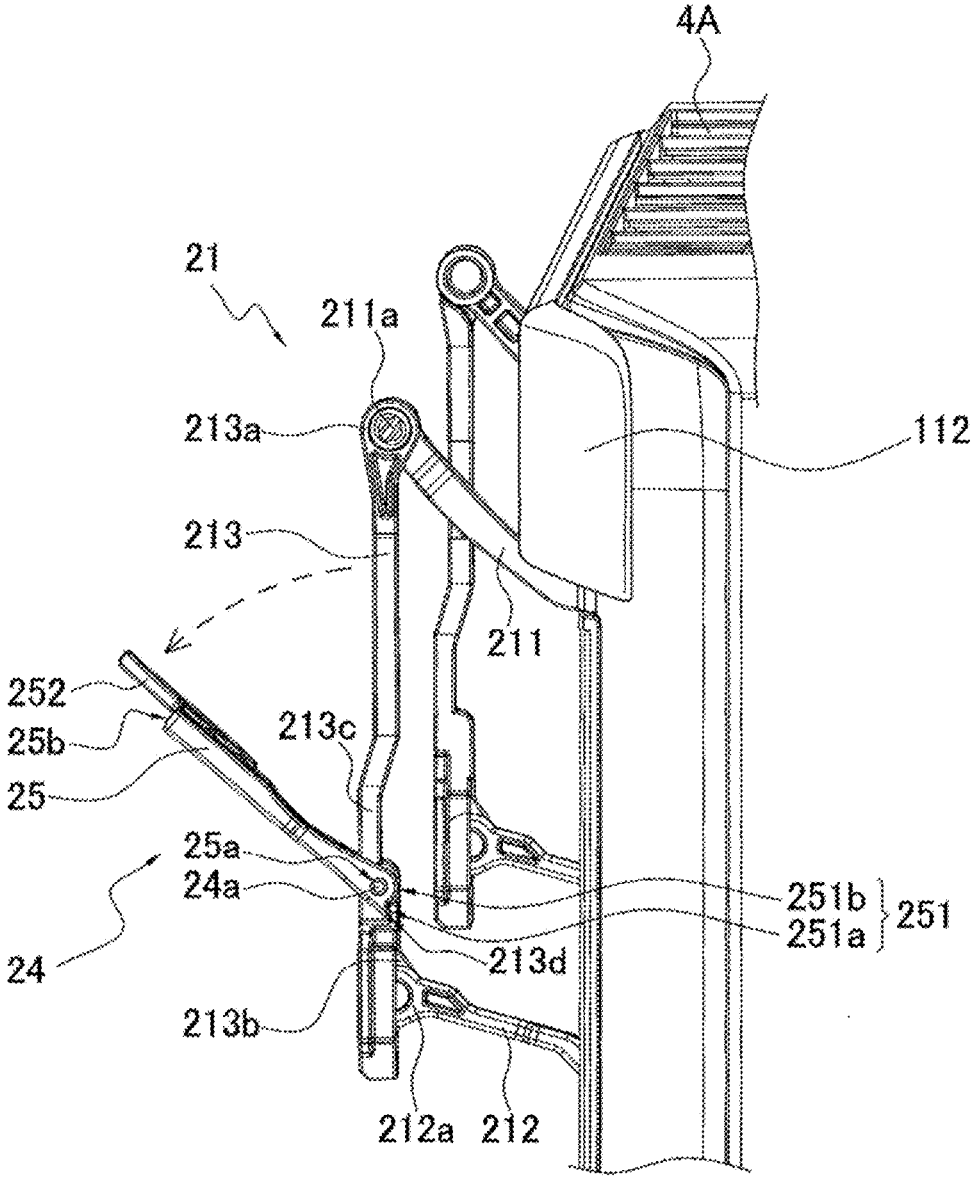
FIG. 11B is a perspective view of the panel support mechanism after the support operates.

FIG. 7 is a longitudinal sectional view of the panel conveyance mechanism 21. FIG. 11A and FIG. 11B are perspective views of a panel support mechanism 24 before and after a support 25 operates, and these figures also depicting the panel conveyance mechanism 21 will be referred to. As depicted in FIG. 7, FIG. 11A, and FIG. 11B, the panel conveyance mechanism 21 is obtained by applying a parallel crank mechanism. The panel conveyance mechanism 21 includes a first crank 211, a second crank 212, a movable link 213, and a fixed link 214.

(3-1-1) First Crank 211

The first crank 211 is a resin member and has each end molded into a columnar or a tubular shape so as to serve as a shaft. There is provided a first shaft 211*a* positioned adjacent to the first panel 111 and rotatably retained by an upper end bearing 213*a* of the movable link 213. As depicted in FIG. 11A, the first shaft 211*a* according to the present embodiment is formed into a columnar projection.

There is further provided a second shaft 211*b* positioned adjacent to the indoor unit body 10 and coupled to an output shaft of a motor (not depicted). As depicted in FIG. 7, the second shaft 211*b* is provided behind the second panel 112. The output shaft of the motor according to the present embodiment receives a resin rod having a quadrilateral section, and the second shaft 211*b* has a center provided with a quadrilateral hole receiving the resin rod.

As depicted in FIG. 7, the first crank 211 includes a curved portion 211*c*. The curved portion 211*c* connects the first shaft 211*a* and the second shaft 211*b*, and extends to be distant obliquely downward from a virtual line (two-dot chain line KL) connecting the center of the first shaft 211*a* and the center of the second shaft 211*b* to have a minimum distance and is then curved to extend toward the virtual line.

When the first panel 111 is lifted upward to have the first shaft 211*a* positioned in front of the second panel 112, the first crank 211 approaches the lower end of the second panel 112. The curved portion 211*c* curves to avoid the lower end of the second panel 112 so as to prevent interference between the first crank 211 and the lower end of the second panel 112.

(3-1-2) Second Crank 212

The second crank 212 is a resin member and has each end molded into a columnar or a tubular shape so as to serve as a shaft. There is provided a first shaft 212*a* positioned adjacent to the first panel 111 and rotatably retained by a lower end bearing 213*b* of the movable link 213. As depicted in FIG. 11A, the first shaft 212*a* according to the present embodiment is formed into a columnar projection.

There is further provided a second shaft 212*b* positioned adjacent to the indoor unit body 10 and rotatably retained by the lower end of the fixed link 214. As depicted in FIG. 7, the second shaft 212*b* according to the present embodiment is formed into a columnar projection.

(3-1-3) Movable Link 213

The movable link 213 is an elongated resin member and is fixed in a vertical posture to the rear surface of the first panel 111. The movable link 213 has upper and lower ends each constituting a bearing. The upper end serves as the upper end bearing 213*a* receiving the first shaft 211*a* of the first crank 211, whereas the lower end serves as the lower end bearing 213*b* receiving the first shaft 212*a* of the second crank 212.

As depicted in FIG. 11A, the upper end bearing 213*a* according to the present embodiment has a bearing hole receiving the columnar projection of the first shaft 211*a* of the first crank 211. The lower end bearing 213*b* has a bearing hole receiving the columnar projection of the first shaft 212*a* of the second crank 212.

(3-1-4) Fixed Link 214

The fixed link 214 is located adjacent to the indoor unit body 10, and does not need to have a specific shape but has only to be provided with at least a bearing for the second shaft 211*b* of the first crank 211 and a bearing for the second shaft 212*b* of the second crank 212.

In the present embodiment, the second shaft 211*b* of the first crank 211 is supported by the output shaft of the motor whereas the second shaft 212*b* of the second crank 212 is supported by a bearing 214*b* positioned below and distant by a predetermined length from the output shaft of the motor.

(3-2) Operation of First Panel 111 at Operation Start

When the first panel 111 is in the state depicted in FIG. 4 and the motor rotates clockwise the second shaft 211*b* of the first crank 211, the first crank 211 turns clockwise. In this case, the first shaft 211*a* of the first crank 211 draws an arc around the second shaft 211*b* and lifts the movable link 213 upward.

The first crank 211 stops turning at a position where the virtual line connecting the first shaft 211*a* and the second shaft 211*b* is inclined upward by about 5 degrees from a horizontal direction. Such a stop position will be called a maximally turned position Rm of the first crank 211 (see FIG. 5 and FIG. 6).

The first shaft 211*a* of the first crank 211 and the upper end bearing 213*a* of the movable link 213 are rotatably connected to each other. The lower end bearing 213*b* of the movable link 213 and the first shaft 212*a* of the second crank 212 are rotatably connected to each other. The bearing 214*b* of the fixed link 214 and the second shaft 212*b* of the second crank 212 are rotatably connected to each other.

The movable link 213 lifted upward keeps the vertical posture and shifts upward to be distant from the indoor unit body 10.

In this case, the "virtual line connecting the first shaft 211*a* and the second shaft 211*b*" of the first crank 211 and a "virtual line connecting the first shaft 212*a* and the second shaft 212*b*" of the second crank 212 are substantially parallel to each other, and a "virtual line connecting the upper end bearing 213*a* and the lower end bearing 213*b*" of the movable link 213 and a "virtual line connecting the output shaft of the motor and the bearing 214*b*" of the fixed link 214 are substantially parallel to each other, so that these four virtual lines form a substantial parallelogram.

When the first crank 211 serves as a driver and rotates, the first panel 111 fixed to the movable link 213 can ascend or descend while being kept in parallel with the fixed link 214.

As depicted in FIG. 5 and FIG. 6, when the first crank 211 reaches the maximally turned position Rm, the first panel 111 is positioned in front of the second panel 112 and the upper ends of the first panel 111 and the second panel 112 are leveled in a front view.

The first panel 111 is set to be vertically longer than the second panel 112 in a front view. When the first panel 111 ascends to have the upper end leveled with the upper end of the second panel 112 in a front view, the first panel 111 covers the second panel 112 so that there seems to be a single panel.

The vertical length of the second panel 112 is equal to the height of the front end of the blow-out port 5. As depicted in FIG. 2B, when the first panel 111 ascends to reach the position (open position OP) where the upper end of the first panel 111 is leveled with the upper end of the second panel 112 in a front view, the front end of the blow-out port 5 is opened completely.

The first panel 111 may be conveyed from the open position OP to the close position CP by turning counter-clockwise the first crank 211 of the panel conveyance mechanism 21 depicted in FIG. 5.

(4) Mechanism Configured Keep Posture of First Panel 111

The panel conveyance mechanism 21 operates when air conditioning indoor unit is in operation as well as upon maintenance such as cleaning of the filter 9. Upon maintenance such as cleaning of the filter 9, a user needs to turn the first panel 111 to cause the lower end of the first panel 111 to be distant from the indoor unit body 10 so as to open the front surface of the indoor unit body 10.

In this case, as depicted in FIG. 2A, the first panel 111 turned at the close position CP causes interference between the upper end of the side surface 111*a* of the first panel 111 and the lower end of the side surface 112*a* of the second panel 112 to generate squeak sound and damage to the first panel 111 and the second panel 112.

In order to prevent such defects, when the user opens the front surface of the indoor unit body 10 for maintenance of the filter 9 or the like, the first panel 111 is conveyed to the open position OP in the present embodiment. As depicted in FIG. 2B, the upper end of the side surface 111*a* of the first panel 111 and the lower end of the side surface 112*a* of the second panel 112 are distant from each other at the open position OP. Turn of the first panel 111 will not cause interference between the upper end of the side surface 111*a* of the first panel 111 and the lower end of the side surface 112*a* of the second panel 112 to prevent generation of squeak sound and damage to the first panel 111 and the second panel 112.

The user can manually convey the first panel 111 from the close position CP to the open position OP. The panel conveyance mechanism 21 is connected to the motor and such work is a burden of the user, so that the first panel 111 is preferably conveyed by the panel conveyance mechanism 21.

The panel conveyance mechanism 21 operates when an operation button 81 or a maintenance preparation button 83 preliminarily provided at a remote control device (see FIG. 3, hereinafter called a remote controller 80) of the air conditioning indoor unit 1 is turned ON.

Upon maintenance, the user initially turns ON the maintenance preparation button 83 to cause the panel conveyance mechanism 21 to shift the first panel 111 to the open position OP.

The user then turns the first panel 111 to have the lower end distant from the indoor unit body 10 in order to open the front surface of the indoor unit body 10. Because the movable link 213 of the panel conveyance mechanism 21 is coupled to the rear surface of the first panel 111, such a coupled state therebetween needs to be changed to a turnable state where the first panel 111 is solely turnable.

The rear surface of the first panel 111 and the movable link 213 of the panel conveyance mechanism 21 thus interpose a hinge mechanism 22, a lock mechanism 23, and the panel support mechanism 24.

(4-1) Hinge Mechanism 22

Figure 8:
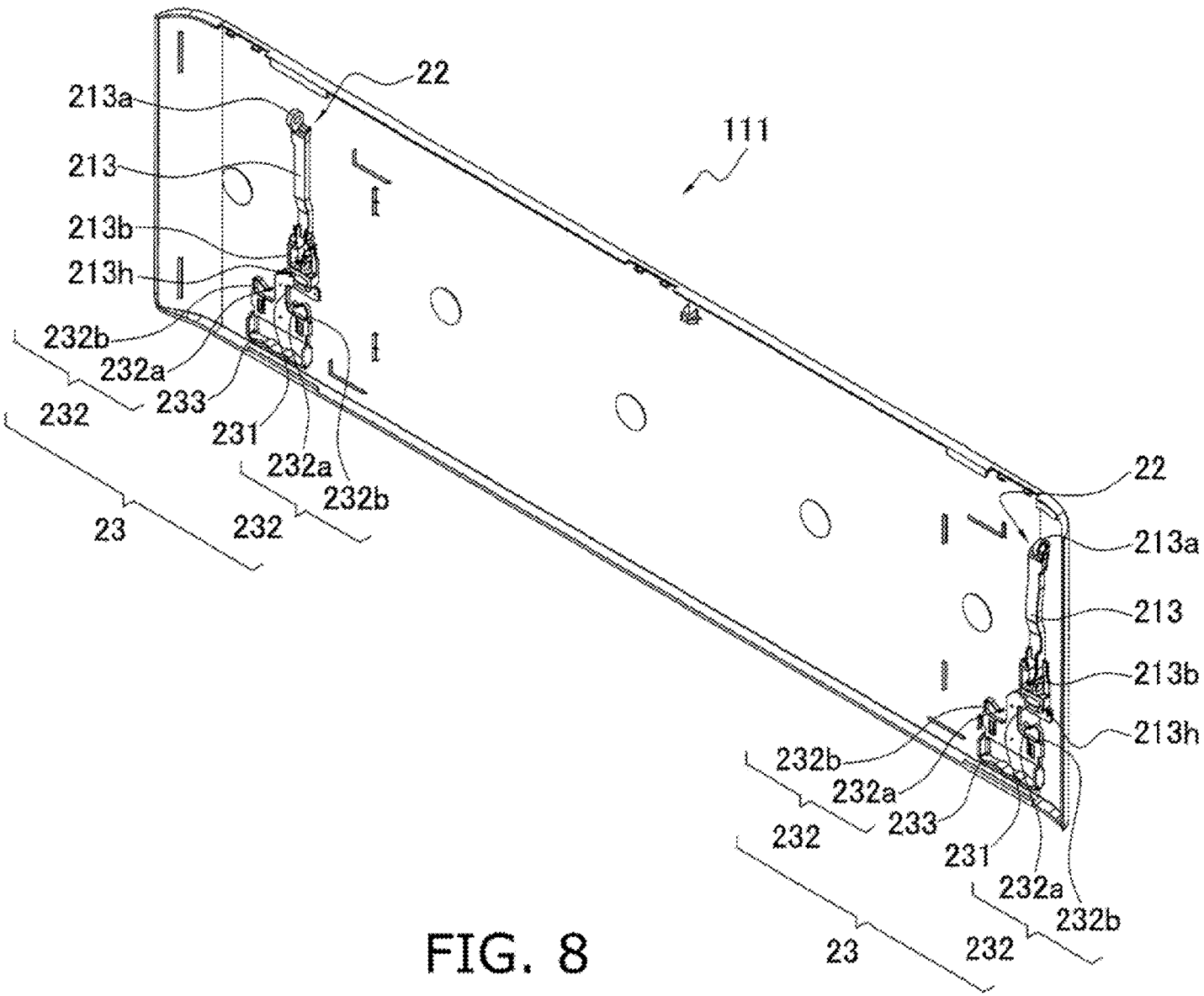
FIG. 8 is a perspective view of a rear surface of a first panel.

The hinge mechanism 22 is configured to turn the first panel 111 about the upper end bearing 213*a* of the movable link 213 in order to open the front surface of the indoor unit body 10 (see FIG. 8).

Specifically, the hinge mechanism 22 is provided on the rear surface of the first panel 111 and retains the upper end bearing 213*a* of the movable link 213. The hinge mechanism 22 may alternatively be constituted by a shaft fitted to the upper end bearing 213*a* of the movable link 213 by snap fitting.

When the lower end of the first panel 111 is shifted to be distant from the indoor unit body 10, the first panel 111 turns about the upper end bearing 213*a* of the movable link 213.

(4-2) Lock Mechanism 23

Figure 9A:
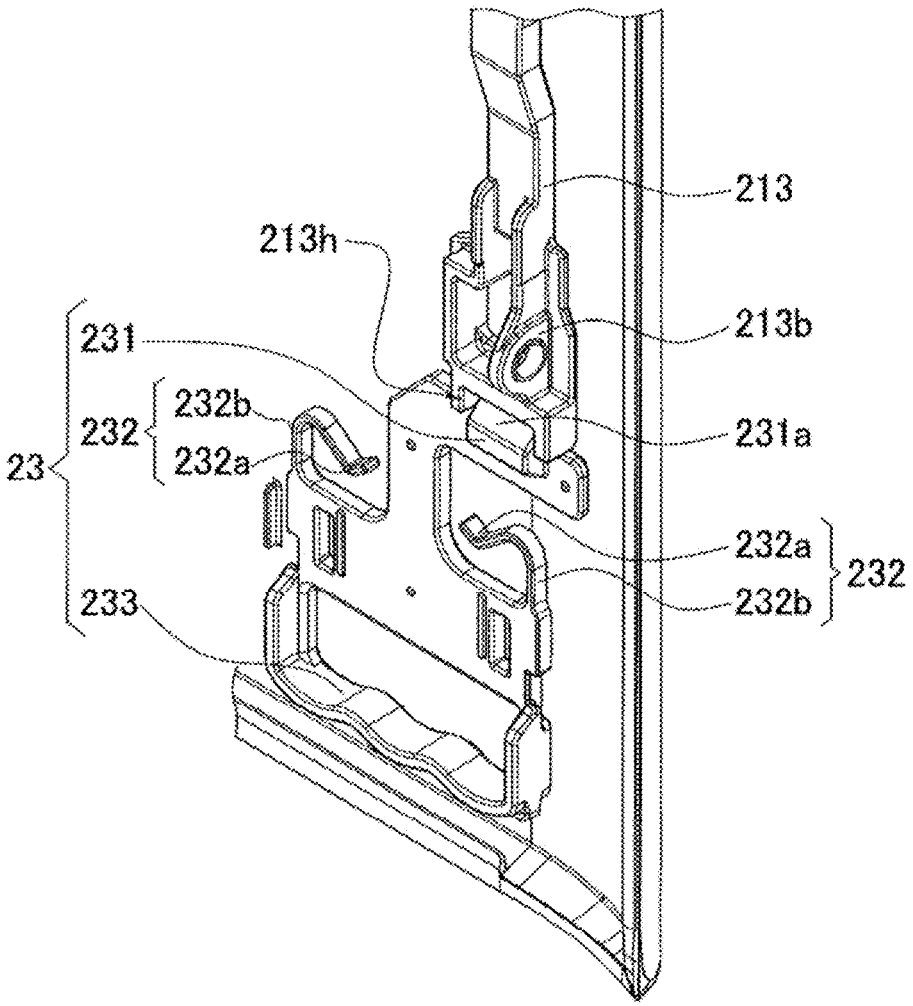
FIG. 9A is an enlarged perspective view of a lock mechanism connecting the first panel and a movable link.
Figure 9B:
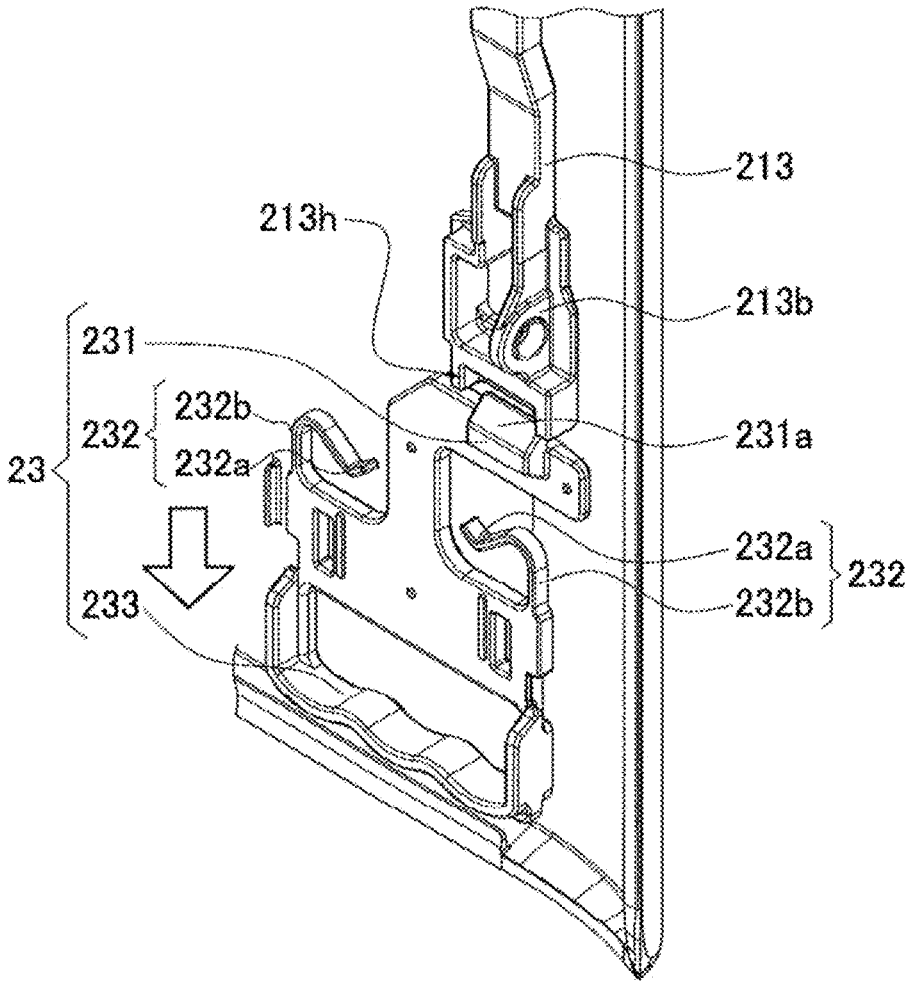
FIG. 9B is an enlarged perspective view depicting an unlocking state of the lock mechanism in FIG. 9A.

FIG. 8 is a perspective view of the lock mechanism 23 disposed on the rear surface of the first panel 111. FIG. 9A is an enlarged perspective view of the lock mechanism 23 between the first panel 111 and the movable link 213. FIG. 9B is an enlarged perspective view depicting an unlocking state of the lock mechanism 23 in FIG. 9A.

As depicted in FIG. 8, FIG. 9A, and FIG. 9B, the first panel 111 has a portion facing the lower end bearing 213*b* of the movable link 213 and provided with the lock mechanism 23 configured to restrain the lower end bearing 213*b* of the movable link 213. The lock mechanism 23 includes a claw 231, a spring 232, and a grip 233. The claw 231, the spring 232, and the grip 233 are made of same resin and is molded integrally in the present embodiment.

(4-2-1) Claw 231

The claw 231 slides along the rear surface of the first panel 111. The claw 231 has a claw tip 231*a* typically inserted to a hole 213*h* provided in a lower portion of the lower end bearing 213*b* of the movable link 213 to prevent the lower end bearing 213*b* from being distant from the rear surface of the first panel 111.

(4-2-2) Spring 232

The spring 232 biases upward the claw 231 such that the claw tip 231*a* of the claw 231 is not distant from the hole 213*h* provided in the lower portion of the lower end bearing 213*b* of the movable link 213. The spring 232 is made of resin and is molded into an arc beam shape. The spring 232 has a first end that is retained by the rear surface of the first panel 111 and will be called a free end 232*a*. The spring 232 has a second end that is fixed to the claw 231 and will be called a fixed end 232*b*. The claw 231 and the spring 232 provide a lock function of the lock mechanism 23 in the present embodiment.

(4-2-3) Grip 233

The grip 233 is hooked by a finger of the user and is connected to the lower end of the claw 231. The rear surface of the first panel 111 located at the open position OP and the indoor unit body 10 form a gap therebetween allowing entry of a hand of the user. When the user hooks by the finger and pulls the grip 233 downward, the claw 231 is descended and the claw tip 231*a* exits the hole 213*h* provided in the lower portion of the lower end bearing 213*b* of the movable link 213, so that the first panel 111 and the lower end bearing 213*b* of the movable link 213 become separable from each other. The grip 233 provides an unlock function of the lock mechanism 23 in the present embodiment.

(4-3) Panel Support Mechanism 24

Figure 10:
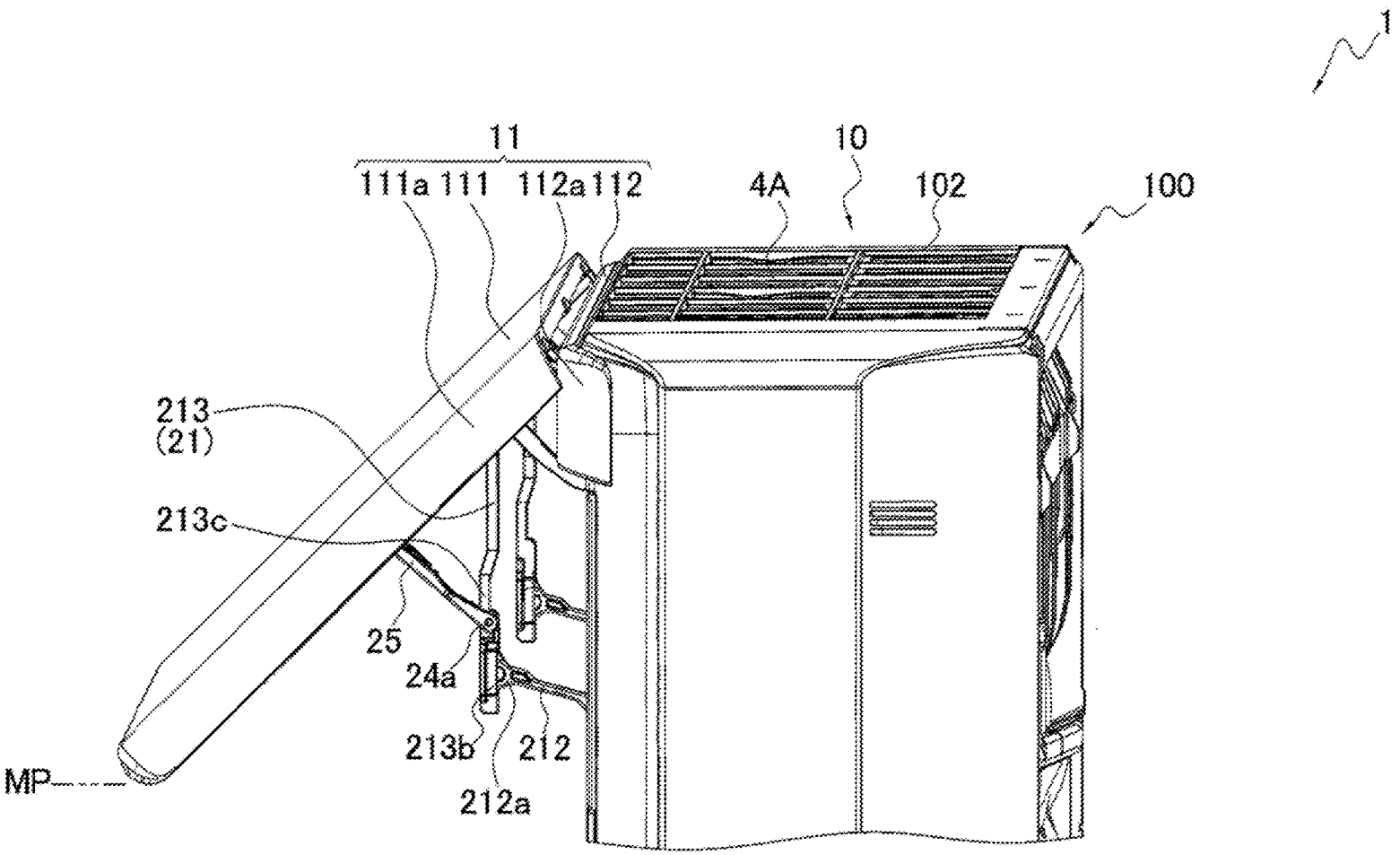
FIG. 10 is a partial perspective view of the air conditioning indoor unit in a case where the first panel is located at a maintenance position.

FIG. 10 is a partial perspective view of the air conditioning indoor unit 1 in a case where the first panel 111 is located at a maintenance position. As depicted in FIG. 10, when the first panel 111 shifts to a position (hereinafter, called a "maintenance position MP") where the front surface of the indoor unit body 10 is opened, the first panel 111 needs to be retained at the maintenance position MP to allow the user to execute work with both hands.

The panel support mechanism 24 is configured to retain the first panel 111 at the maintenance position MP. As depicted in FIG. 10, the panel support mechanism 24 includes a shaft 24*a* provided on the movable link 213 of the panel conveyance mechanism 21, and the support 25 turnably supported by the shaft 24*a*.

(4-3-1) Shaft 24*a*

Figure 12:
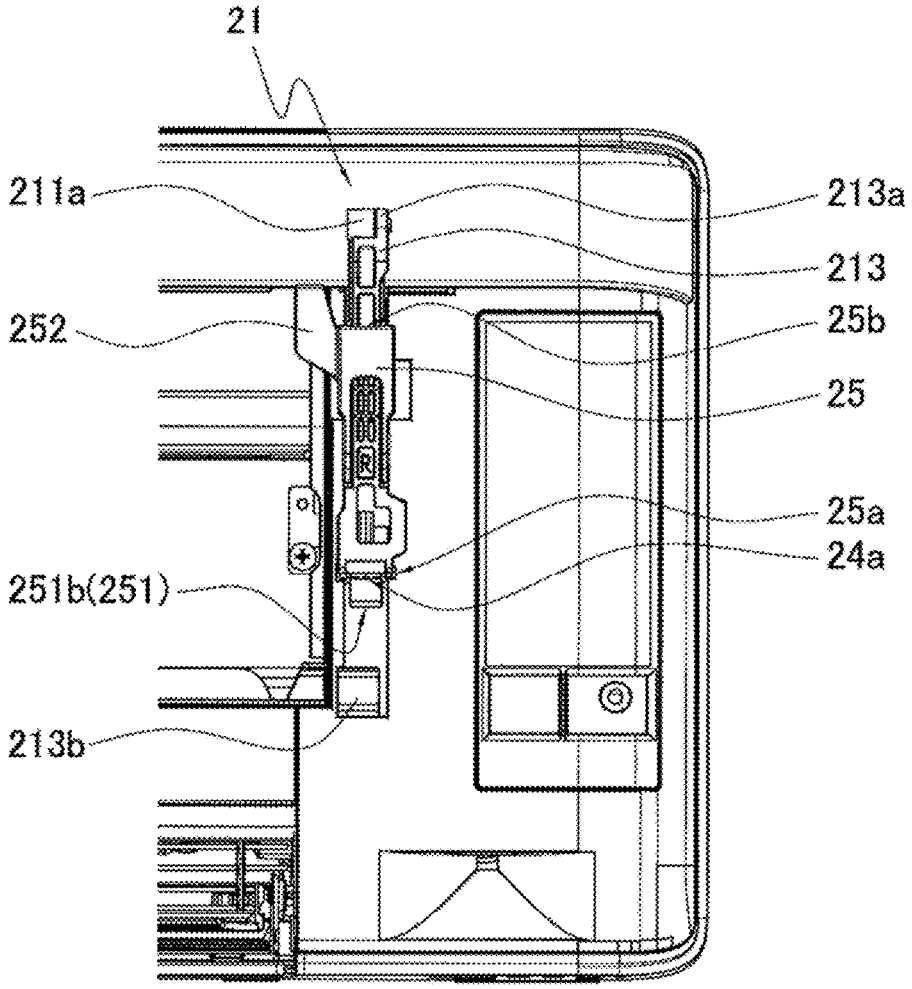
FIG. 12 is a front view of the panel support mechanism before the support operates.

FIG. 11A is a perspective view of the panel support mechanism 24 before the support 25 operates. FIG. 11B is a perspective view of the panel support mechanism 24 after the support 25 operates. FIG. 12 is a front view of the panel support mechanism 24 before the support 25 operates.

As depicted in FIG. 11A, FIG. 11B, and FIG. 12, the shaft 24*a* has a pin shape projecting outward from the both side surfaces of the movable link 213. The shaft 24*a* is provided within a section 213*c* connecting the upper end bearing 213*a* and the lower end bearing 213*b* of the movable link 213, between the center of the section 213*c* and the lower end bearing 213*b*.

(4-3-2) Support 25

The support 25 has an elongated shape having a section perpendicular to the longitudinal direction and recessed into a cornered U shape. The support 25 has an end provided with a shaft hole 25*a* receiving the shaft 24*a*.

For easier description, the end of the support 25 provided with the shaft hole 25*a* will be called a first end 251 and another end will be called a second end 252. When the shaft 24*a* is inserted to the shaft hole 25*a* at the first end 251, the support 25 is turnable relatively to the movable link 213.

In a case where the support 25 is pushed to come closer to the movable link 213 and turned, part of the section 213*c* of the movable link 213 is fitted to a recessed portion of the support 25, and the support 25 and the movable link 213 are overlapped with each other, so that the support 25 cannot be pushed any further.

In another case where the support 25 stops being pushed to come closer to the movable link 213, the support 25 turns to be distant from the movable link 213. As depicted in FIG. 11A, the support 25 has a center of gravity 25*g* positioned above and ahead (to be distant from the movable link 213) of the shaft 24*a*, and thus naturally turns to be distant from the movable link 213 unless being restrained.

The first end 251 has an end surface including an arc surface 251*a* having a central angle of 100 degrees around the shaft hole 25*a* and an inclined surface 251*b* projecting in the longitudinal direction of the support 25 from the arc surface 251*a*.

When the support 25 turns to be distant from the movable link 213 from the state where the part of the section 213*c* of the movable link 213 is fitted to the recessed portion of the support 25, the arc surface 251*a* and the inclined surface 251*b* turn simultaneously. The movable link 213 has a proceed blocking surface 213*d* shifted in a turning direction from the inclined surface 251*b* by 60 degrees and facing the inclined surface 251*b*.

When the support 25 turns by 60 degrees to be distant from the movable link 213, the inclined surface 251*b* touches the proceed blocking surface 213*d* to stop turn of the support 25.

While the lower end bearing 213*b* of the movable link 213 and the first panel 111 located at the open position OP are kept coupled to each other, the support 25 is interposed between the rear surface of the first panel 111 and the section 213*c* of the movable link 213 and thus stays still.

(4-3-3) Operation of Support 25

When the grip 233 of the lock mechanism 23 is pulled downward (see FIG. 9B), the lower end bearing 213*b* of the movable link 213 and the first panel 111 are uncoupled, and the lower end of the first panel 111 is pulled by a hand of the user to be distant from the indoor unit body 10, the hinge mechanism 22 causes the first panel 111 to turn about the upper end bearing 213*a* of the movable link 213.

In a case where the first panel 111 starts turning to be distant from the indoor unit body 10, the support 25 simultaneously starts turning about the shaft 24*a* to follow the first panel 111. When the first panel 111 reaches the maintenance position MP, the support 25 turns by 60 degrees to be distant from the movable link 213 and the inclined surface 251*b* touches the proceed blocking surface 213*d* to stop turn of the support 25.

Even if the user releases the first panel 111 in this state, the second end 252 of the support 25 supports the rear surface of the first panel 111 to stop the first panel 111 at the maintenance position MP and open the front surface of the indoor unit body 10.

In another case where the first panel 111 is returned from an inclined posture upon maintenance to a vertical posture, the support 25 is temporarily lifted upward and the first panel 111 is then pushed with a hand, so that the second end 252 of the support 25 slides on the rear surface of the first panel 111 to approach the movable link 213 of the panel conveyance mechanism 21. Eventually, the part of the section 213*c* of the movable link 213 is fitted to the recessed portion of the support 25 and the support 25 and the movable link 213 are overlapped with each other, so that the support 25 cannot be pushed any further. The first panel 111 returns to the vertical posture at this point.

As depicted in FIG. 11A, FIG. 11B, and FIG. 12, the second end 252 is not located at a body end 25*b* of the support 25, but temporarily rises backward from a left side surface of the body end 25*b* of the support 25 in a front view in FIG. 12, is then bent leftward, and extends along a sheet surface (vertically). The second end 252 is closer to the indoor unit body 10 in comparison to the body end 25*b*.

The second end 252 deviates from the body end 25*b* of the support 25 as described above. Even if a buckling load is applied from the tip of the second end 252, the second end 252 warps to generate force shifting the body end 25*b* toward the indoor unit body 10. The support 25 inevitably has a moment toward the indoor unit body 10 in this case.

Even if the user erroneously pushes the first panel 111 without shifting the support 25 upward, the second end 252 of the support 25 warps upon receiving certain force and subsequently slides on the rear surface of the first panel 111 without causing damage.

As described above, the support 25 of the panel support mechanism 24 is accommodated to be overlapped with the movable link 213 of the panel conveyance mechanism 21 when the first panel 111 has the vertical posture at the close position CP and the open position OP, and descends by its own weight to support the first panel 111 when the first panel 111 has the inclined posture at the maintenance position MP.

(4-3-4) Other Application Examples

The panel support mechanism 24 is also applicable to an air conditioning indoor unit including a front panel (including a front grille) configured not to be driven and be turned forward for maintenance of a filter, such as a floorstanding air conditioning indoor unit.

The present embodiment exemplifies the first panel 111 in the inclined posture at the maintenance position MP being supported by the support 25 that is shifted downward by its own weight from the movable link 213. The present invention should not be limited to such a configuration. For example, the support 25 may be turnably retained by the rear surface of the first panel 111 and may be configured to be shifted downward by its own weight from the first panel 111 and touch the movable link 213 to be stopped when the first panel 111 is inclined.

(5) Detailed Description of First Airflow Direction Adjusting Blade 30

Figure 13A:
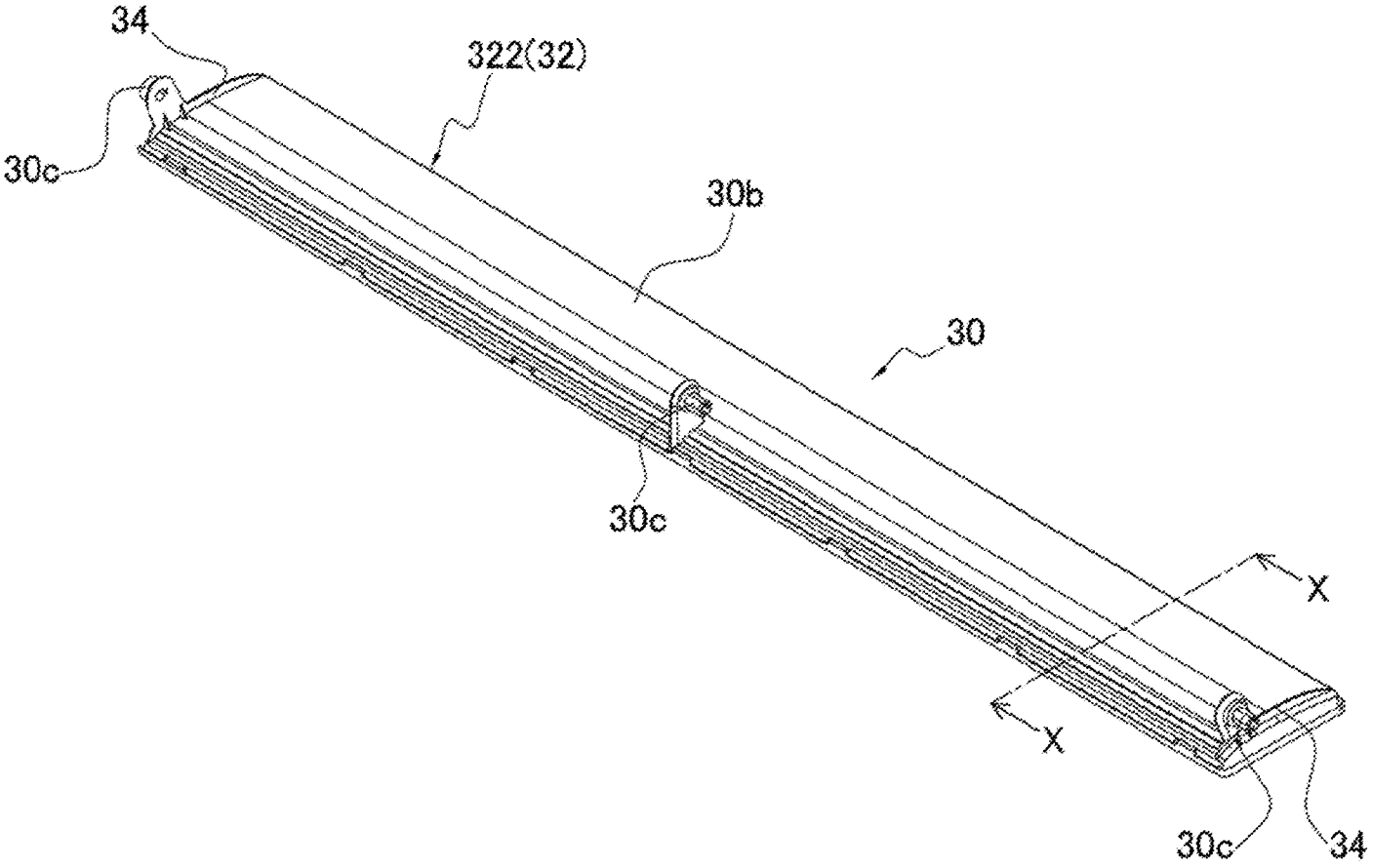
FIG. 13A is a perspective view of a first airflow direction adjusting blade not in operation.
Figure 13B:
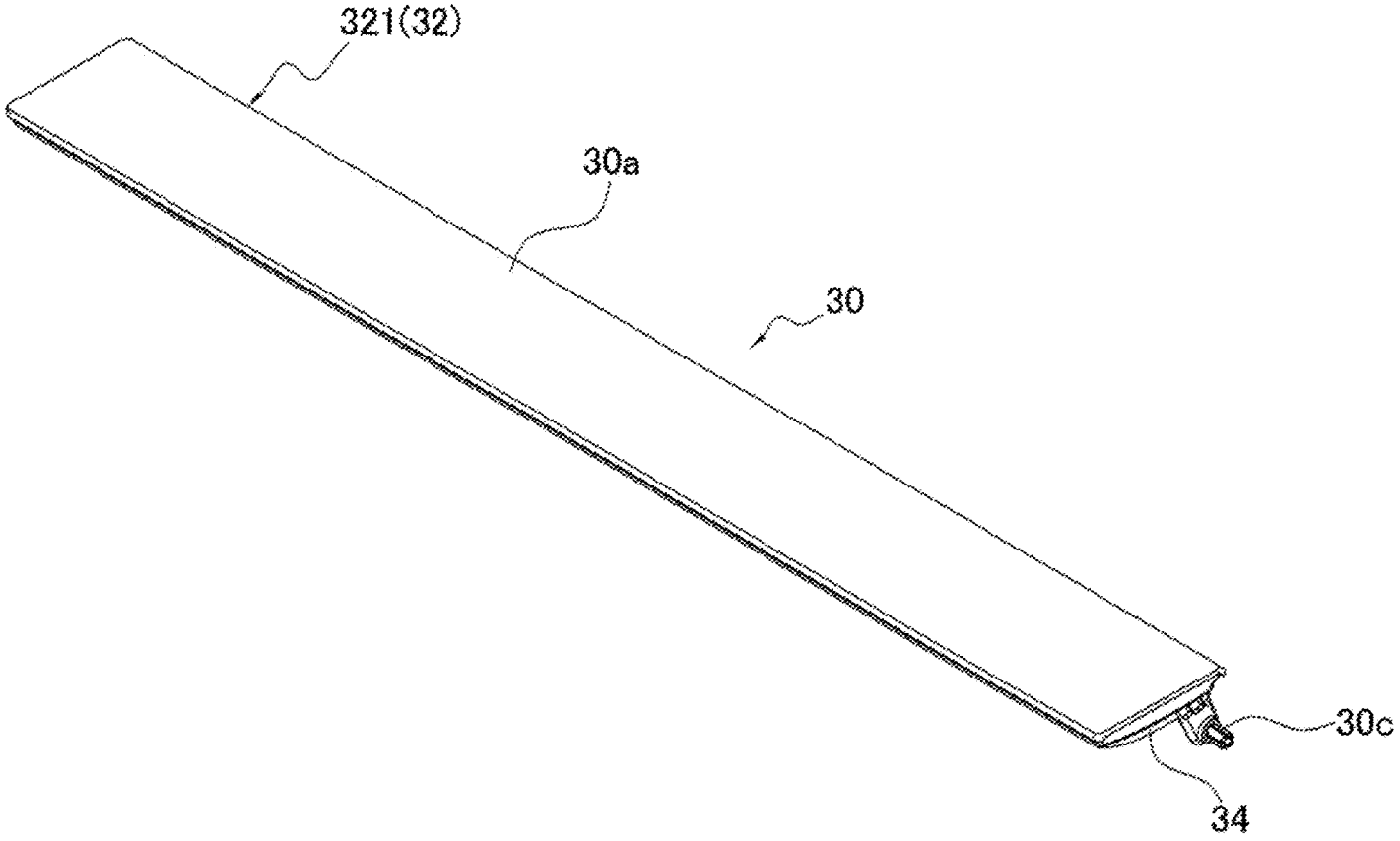
FIG. 13B is a perspective view of the first airflow direction adjusting blade in operation.
Figure 14A:
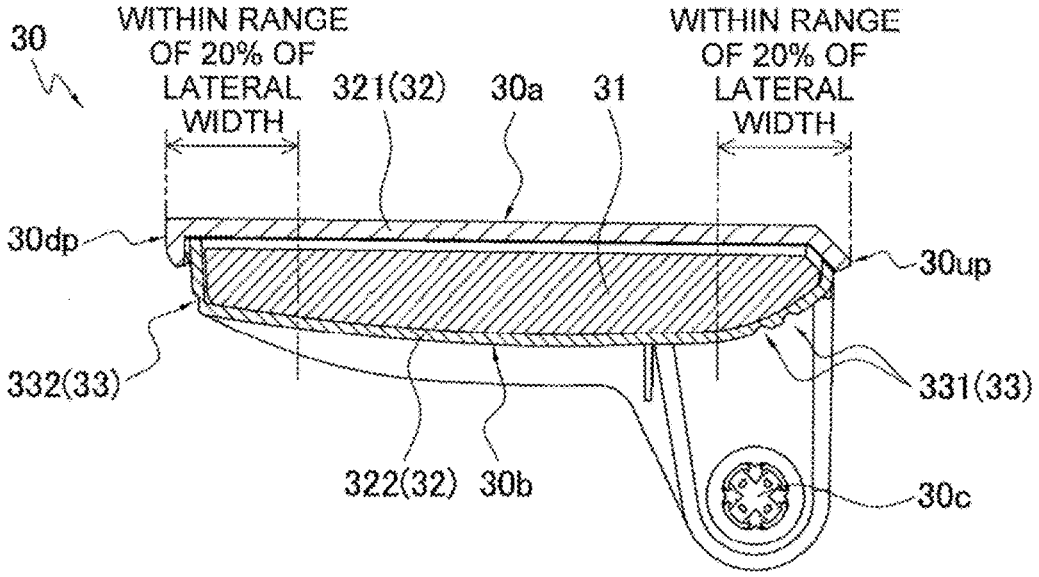
FIG. 14A is a sectional view taken along line X-X indicated in FIG. 13A.

FIG. 13A is a perspective view of the first airflow direction adjusting blade 30 not in operation. FIG. 13B is a perspective view of the first airflow direction adjusting blade 30 in operation. FIG. 14A is a sectional view taken along line X-X indicated in FIG. 13A.

As depicted in FIG. 13A, FIG. 13B, and FIG. 14A, the first airflow direction adjusting blade 30 includes a heat insulator 31 made of expanded polystyrene and interposed between a first blade member 321 constituting the decorative surface 30*a* and a second blade member 322 constituting the Coanda surface 30*b*. The first blade member 321 and the second blade member 322 will be collectively called a "blade member 32".

The first airflow direction adjusting blade 30 is configured to adjust an airflow direction of blow-out air from the blow-out port 5 via the blow-out flow path 18. As depicted in FIG. 4, the first airflow direction adjusting blade 30 covers the lower end of the blow-out port 5 with the decorative surface 30*a* being directed just downward when the air conditioning indoor unit 1 is in an operation stop state.

As depicted in FIG. 6, the first airflow direction adjusting blade 30 rotates by 180 degrees about a shaft 30*c* when the air conditioning indoor unit 1 starts operation. The first airflow direction adjusting blade 30 reaches the upper end of the blow-out port 5 (see FIG. 14A) in this case. In order to avoid interference with the first panel 111, the first airflow direction adjusting blade 30 inevitably turns after the first panel 111 operates or in a manner of chasing the operation of the first panel 111.

For easier description, assume that the first airflow direction adjusting blade 30 rotates by 180 degrees about the shaft to reach a maximum open position MOP (see FIG. 6).

The first airflow direction adjusting blade 30 stays still at the maximum open position MOP with the decorative surface 30*a* being directed upward and the Coanda surface 30*b* being directed downward. During cooling operation, the front blow-in port 4B of the indoor unit body 10 is located above the decorative surface 30*a* and indoor air is sucked therethrough. The blow-out port 5 is located below the Coanda surface 30*b* and cool air blows out.

(5-1) Countermeasure Against Dew Condensation at First Airflow Direction Adjusting Blade 30

The blow-out port 5 has an upper wall forming a slight gap from the decorative surface 30*a* to allow indoor air to easily enter. The second blade member 322 constituting the Coanda surface 30*b* is cooled by cool air during cooling operation, and the first blade member 321 constituting the decorative surface 30*a* is also cooled due to heat transfer, so that the decorative surface 30*a* has dew condensation.

Heat transfer in the thickness direction of the first airflow direction adjusting blade 30 is inhibited by the expanded polystyrene constituting the heat insulator 31. Accordingly, the first blade member 321 is cooled due to internal heat conduction of the first blade member 321 and the second blade member 322.

Cool air flows along the Coanda surface 30*b* of the first airflow direction adjusting blade 30 located at the maximum open position MOP. The cool air separates from the Coanda surface 30*b* at a distal end having change in arc curvature. Indoor air is caught by an eddy formed after separation and comes into contact with the first airflow direction adjusting blade 30 to form dew condensation.

(5-1-1) Concave Portion 33

In order to prevent dew condensation as described above, the first airflow direction adjusting blade 30 is provided with concave portions 33 formed by reducing a thickness of the second blade member 322. The concave portions 33 are provided at both ends of the first airflow direction adjusting blade 30, and includes a first concave portion 331 and a second concave portion 332.

As depicted in FIG. 14A, when the first airflow direction adjusting blade 30 is located at the maximum open position MOP, the first concave portion 331 is positioned within a range of 20% of a lateral width of the first airflow direction adjusting blade 30, downstream of an upstream end 30 up of the first airflow direction adjusting blade 30 in the flow of blow-out air.

When the first airflow direction adjusting blade 30 is located at the maximum open position MOP, the second concave portion 332 is positioned within a range of 20% of the lateral width of the first airflow direction adjusting blade 30 and upstream of a downstream end 30*dp* of the first airflow direction adjusting blade 30 in the flow of blow-out air.

Figure 14B:
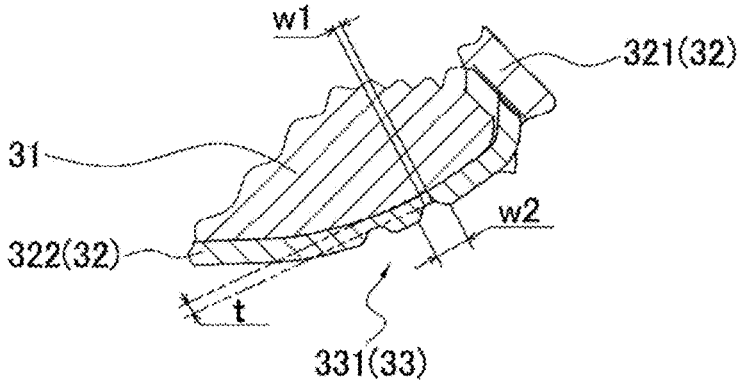
FIG. 14B is an enlarged sectional view of a first concave portion.
Figure 14C:
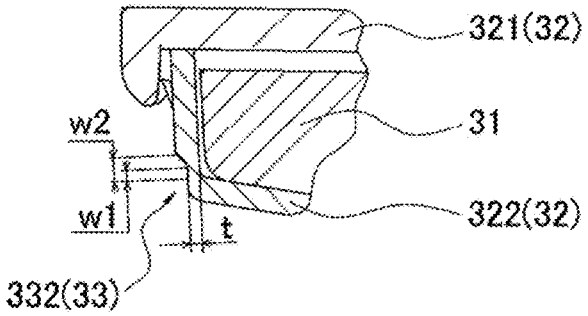
FIG. 14C is an enlarged sectional view of a second concave portion.

FIG. 14B is an enlarged sectional view of the first concave portion 331. FIG. 14C is an enlarged sectional view of the second concave portion 332. As depicted in FIG. 14B and FIG. 14C, the first concave portion 331 and the second concave portion 332 are formed by reducing the thickness of the second blade member 322 by 35% to 60%. The first concave portion 331 and the second concave portion 332 have a minimum thickness t set within a range from 40% to 65% of the thickness of the second blade member 322 excluding the first concave portion 331 and the second concave portion 332.

The minimum thickness of the first concave portion 331 and the second concave portion 332 seems to be preferably as small as possible. The second blade member 322 according to the present embodiment is produced by resin injection molding, so that the minimum thickness is set within the range from 40% to 65% of the thickness of the second blade member 322 as a thickness allowing molten resin to reliably flow into a mold. The first concave portion 331 and the second concave portion 332 each have a bottom having a rear surface supported by the expanded polystyrene constituting the heat insulator 31 and having no deterioration in strength.

The first concave portion 331 and the second concave portion 332 each have a concave width set to include a concave bottom width w1 sized correspondingly to 40% to 65% of the thickness of the second blade member 322 and a concave entrance w2 sized correspondingly to 100% to 200% of the thickness of the second blade member 322, and the concave width is preferably set within a range from 0.6 mm to 2.4 mm.

Heat transferred through the second blade member 322 is blocked by the portions having the minimum thickness of the first concave portion 331 and the second concave portion 332, to inhibit temperature decrease in sections from the first concave portion 331 and the second concave portion 332 to the first blade member 321. This also inhibits temperature decrease at a portion in contact with warm indoor air to inhibit dew condensation.

The first concave portion 331 and the second concave portion 332 are not limited in terms of their numbers. It is preferred to provide two first concave portions 331 and one second concave portion 332 in view of the fact that a portion upstream of the flow of blow-out air tends to be cooled.

Some air conditioning indoor unit has a plurality of grooves at a portion hit by not blow-out air but indoor air. These grooves are provided to hold condensate to be evaporated by wind, and are completely different from the first concave portion 331 and the second concave portion 332 provided for reduction of heat transfer to a start point and an end point hit by cool air where the cool air and warm air separate from each other.

(5-1-2) Wall 34

The above description assumes that dew condensation is formed by cooled indoor air entering the gap between the upper wall of the blow-out port 5 and the decorative surface 30*a* as well as indoor air caught by the eddy formed after separation of cool air flowing along the Coanda surface 30*b* of the first airflow direction adjusting blade 30.

A phenomenon other than the above may form dew condensation. Specifically. the perpendicular airflow direction adjusting blade 50 may cause cool air flowing along the Coanda surface 30*b* of the first airflow direction adjusting blade 30 located at the maximum open position MOP (see FIG. 6) to hit a side wall out of walls constituting the blow-out port 5 to turn onto the decorative surface 30*a*.

The decorative surface 30*a* of the first airflow direction adjusting blade 30 located at the maximum open position MOP and the upper wall out of the walls constituting the blow-out port 5 form the gap having negative pressure that will cause cool air to flow upward to the decorative surface 30*a*, and dew condensation is formed in this case.

As depicted in FIG. 3A and FIG. 3B, the second blade member 322 according to the present embodiment has a lateral end in the longitudinal direction provided with a wall 34 rising in the thickness direction. When the perpendicular airflow direction adjusting blade 50 causes air to flow leftward and rightward, cool air flowing obliquely across the Coanda surface 30*b* of the first airflow direction adjusting blade 30 hits the wall 34 and flows below the side wall of the blow-out port 5, in which case there is generated no flow turning onto the decorative surface 30*a* of the first airflow direction adjusting blade 30. This configuration inhibits dew condensation.

(6) Detailed Description of Second Airflow Direction Adjusting Blade 40

In a state where the air conditioning indoor unit 1 is not in operation as depicted in FIG. 4, the second airflow direction adjusting blade 40 is positioned behind the first panel 111 located at the close position CP and above the first airflow direction adjusting blade 30 located at the initial position SP so as to be invisible.

In another state where the air conditioning indoor unit 1 is in operation as depicted in FIG. 6, the first panel 111 shifts to the open position OP to open the front end of the blow-out port 5 and the first airflow direction adjusting blade 30 turns to be positioned above the second airflow direction adjusting blade 40 to open the lower end of the blow-out port 5 to expose the second airflow direction adjusting blade 40 via the blow-out port 5.

Figure 15:
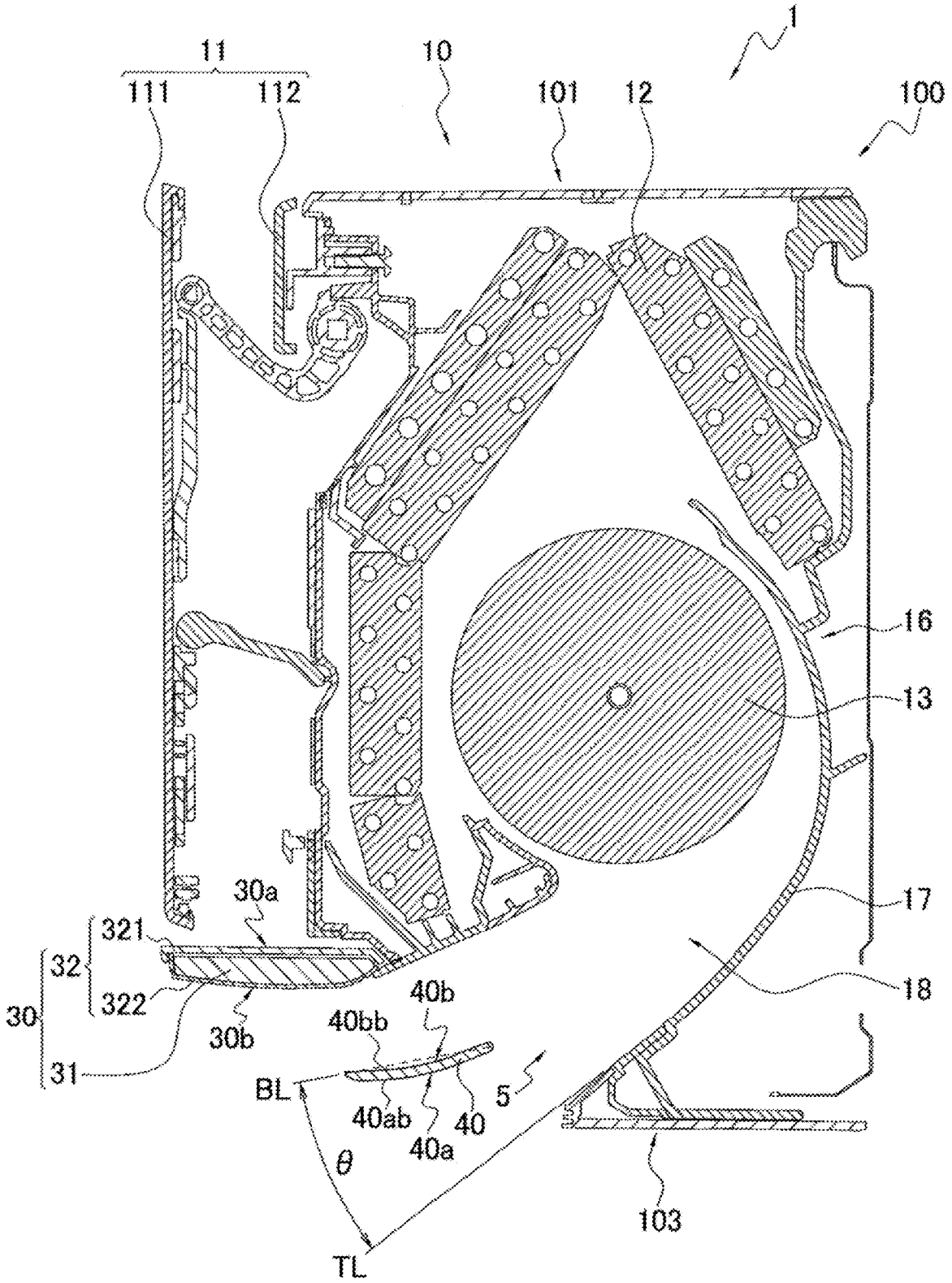
FIG. 15 is a longitudinal sectional view of the air conditioning indoor unit, indicating an inclination angle of a second airflow direction adjusting blade.

FIG. 15 is a longitudinal sectional view of the air conditioning indoor unit 1, indicating an inclination angle of the second airflow direction adjusting blade 40. As depicted in FIG. 15, the second airflow direction adjusting blade 40 has the convex surface 40*a* directed downward and the concave surface 40*b* directed upward. Cool air flowing along the upper concave surface 40*b* thus flows upward toward the first airflow direction adjusting blade 30. Such a flow along the concave surface 40*b* will be called a main airflow.

Cool air flowing along the lower convex surface 40*a* keeps flowing along the convex surface 40*a* in parallel with the main airflow if the angle (hereinafter, referred to as an "inclination angle θ") of the second airflow direction adjusting blade 40 is within a predetermined angle range.

The inclination angle θ of the second airflow direction adjusting blade 40 indicates an angle of a virtual line BL including a frontmost end and a rearmost end of the second airflow direction adjusting blade 40 relative to a tangent line TL at a terminal end of a scroll 17.

When the inclination angle θ of the second airflow direction adjusting blade 40 is out of the predetermined angle range, cool air flows halfway along a curved surface and separates before becoming directed toward the first airflow direction adjusting blade 30 to be distant from the main airflow.

Cool air flowing along the convex surface 40*a* separates immediately after having passed a vertex of the convex surface 40*a*, or at the center of a section connecting the vertex and a downstream-side end of the convex surface 40*a*. Indoor air higher in temperature than the cool air not flowing along the convex surface 40*a* any more enters to form dew condensation.

A section connecting a deepest point and a downstream-side end of the concave surface 40*b* will be called a concave second half section 40*bb*, and a section connecting the vertex and the downstream-side end of the convex surface 40*a* will be called a convex second half section 40*ab*.

The applicant has tested to find that, when the perpendicular airflow direction adjusting blade 50 according to the present embodiment swings to the left or to the right, the convex second half section 40*ab* at each end of the second airflow direction adjusting blade 40 is likely to have dew condensation.

(6-1) Countermeasure Against Dew Condensation at Second Airflow Direction Adjusting Blade 40

As described above, cool air does not separate in the convex second half section 40*ab* and the second airflow direction adjusting blade 40 is entirely surrounded with cool air unless the inclination angle θ of the second airflow direction adjusting blade 40 does not exceed the predetermined angle, to prevent dew condensation at the second airflow direction adjusting blade 40.

(6-1-1) Relation Between Posture of Second Airflow Direction Adjusting Blade 40 and Blow-Out Air Temperature The applicant researched to find that dew condensation is inhibited in a case where the inclination angle θ of the second airflow direction adjusting blade 40 is within a range from 0 degrees to 5 degrees while blow-out air has a temperature Tb within a range from 12° C. to 13° C.

In another case where the user prefers to have an inclination angle causing cool air to separate in the convex second half section 40*ab*, in other words, where the inclination angle θ of the second airflow direction adjusting blade 40 is set to be out of the range from 0 degrees to 5 degrees, the temperature Tb of blow-out air needs to be increased to a range from 14° C. to 16° C. for increase in dewpoint temperature, which narrows parameter flexibility.

The applicant aims to expand the range of the inclination angle θ of the second airflow direction adjusting blade 40 as well as inhibit dew condensation. In order to achieve such an object, cool air flowing along the convex surface 40*a* needs to flow without separating in the convex second half section 40*ab*.

(6-1-2) Through Hole 43

In order to cause cool air to flow without separating in the convex second half section 40*ab* of the convex surface 40*a*, the second airflow direction adjusting blade 40 according to the present embodiment has a longitudinal end provided with a through hole 43 passing in the thickness direction of the second airflow direction adjusting blade 40. The through hole 43 will be described below with reference to the drawings.

Figure 16A:
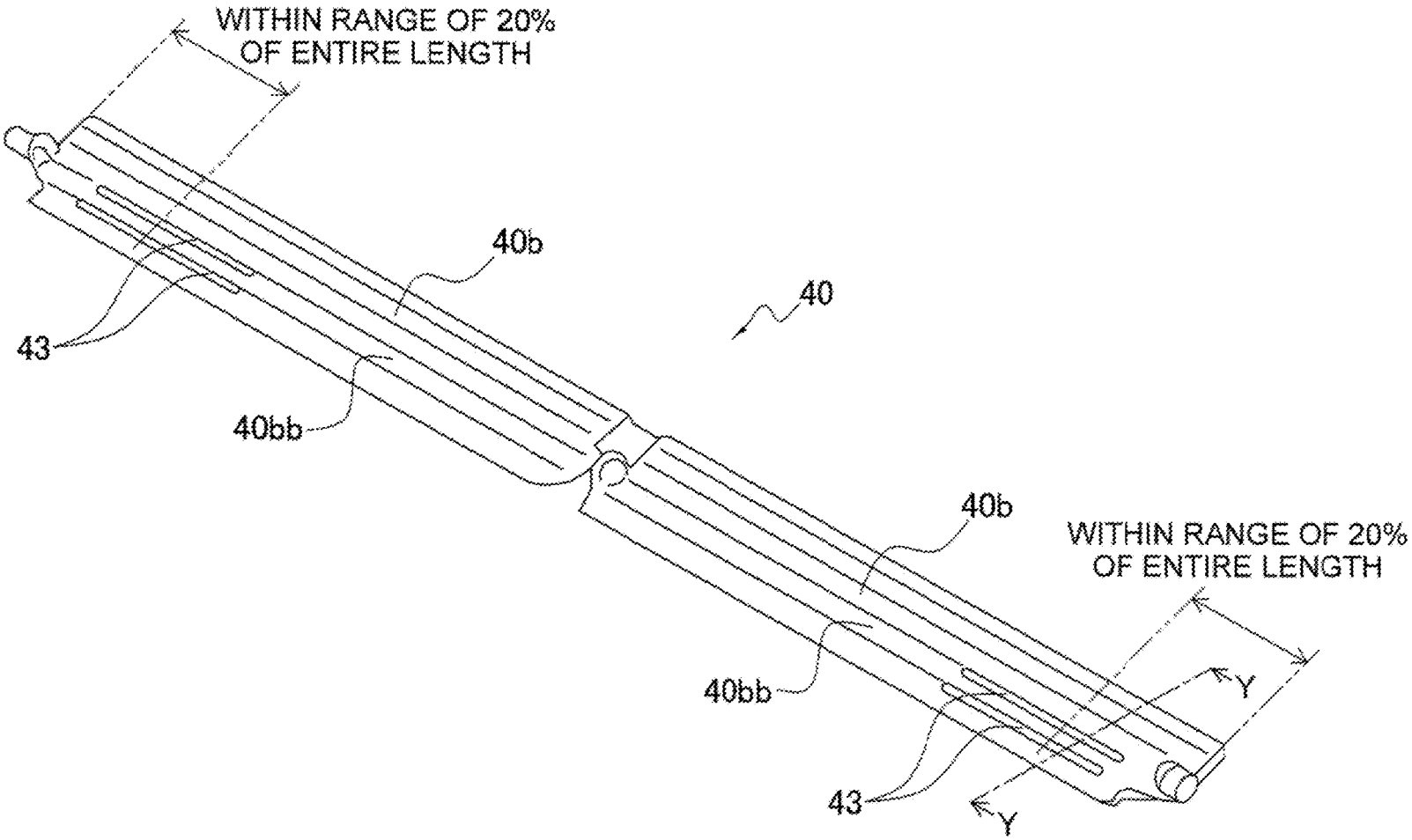
FIG. 16A is a perspective view of the second airflow direction adjusting blade.
Figure 16B:
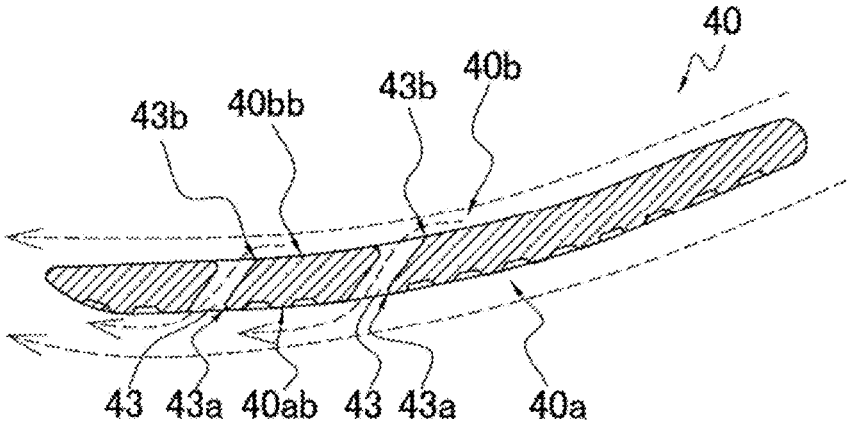
FIG. 16B is a sectional view taken along line Y-Y indicated in FIG. 16A.

FIG. 16A is a perspective view of the second airflow direction adjusting blade 40. FIG. 16B is a sectional view taken along line Y-Y indicated in FIG. 16A. As depicted in FIG. 16A and FIG. 16B, the through hole 43 is provided to cause cool air flowing along the concave second half section 40*bb* of the concave surface 40*b* to flow to the convex second half section 40*ab* of the convex surface 40*a* (see dotted arrows indicated in FIG. 16B).

The through hole 43 has an opening 43*b* provided in the concave second half section 40*bb* is positioned upstream of an opening 43*a* provided in the convex second half section 40*ab*. The through hole 43 thus extends forward and downward in an obliquely downward direction.

Provision of the through hole 43 causes part of cool air flowing along the concave surface 40*b* to pass through the through hole 43, flow out to the convex second half section 40*ab*, and flow toward the downstream-side end. This attracts cool air originally having flown along the convex second half section 40*ab* so as not to separate.

The through hole 43 is a long hole extending in the longitudinal direction of the second airflow direction adjusting blade 40. The through hole 43 is at least partially located in a section from a region where a virtual plane including a vertical plane 50*a* of the blade piece 501 located at a farthest end opposite to a swing direction of the perpendicular airflow direction adjusting blade 50 located at a maximum swung position in actual use crosses the second airflow direction adjusting blade 40 to the closest end, to the region, of the second airflow direction adjusting blade 40.

As depicted in FIG. 16A, the through hole 43 according to the present embodiment extends in a range of 20% of the entire longitudinal length from each end. In an exemplary case where the perpendicular airflow direction adjusting blade 50 is located at a maximum leftward swung position, air has a weak flow in a section on the right of the region where the virtual plane including the vertical plane 50*a* of the rightmost blade piece 501 crosses the second airflow direction adjusting blade 40 (e.g. a range of 80 mm from the right end), and the airflow is likely separate from the convex surface 40*a* of the second airflow direction adjusting blade 40 and is likely to come into contact with indoor air to form dew condensation.

When the through hole 43 is provided to extend in the range of 20% of the entire longitudinal length from each end, cool air having passed through the through hole 43 flows along the convex second half section 40*ab* of the convex surface 40*a* to attract cool air flowing from an upstream portion toward the convex second half section 40*ab* and prevent separation from the convex second half section 40*ab*. This prevents indoor air from contacting the second airflow direction adjusting blade 40 for inhibition of dew condensation.

The through hole 43 is provided as described above to inhibit dew condensation. The applicant thus researched to find that dew condensation is inhibited when the inclination angle θ of the second airflow direction adjusting blade 40 is within a range from 0 degrees to 32 degrees while the temperature Tb of blow-out air is within the range from 12° C. to 13° C.

The through hole 43 is not necessarily the long hole, but may alternatively include a plurality of round holes provided continuously in one direction, or a plurality of "long holes shorter than the long hole according to the above embodiment" provided continuously in one direction.

(7) Modification Example

In the front panel 11 according to the above embodiment, the second panel 112 is fixed and only the first panel 111 shifts to be positioned in front of the second panel 112 to open the front surface of the indoor unit body 10. The present invention should not be limited to this configuration, and both the first panel 111 and the second panel 112 may shift to open the front surface of the indoor unit body 10.

Figure 17:
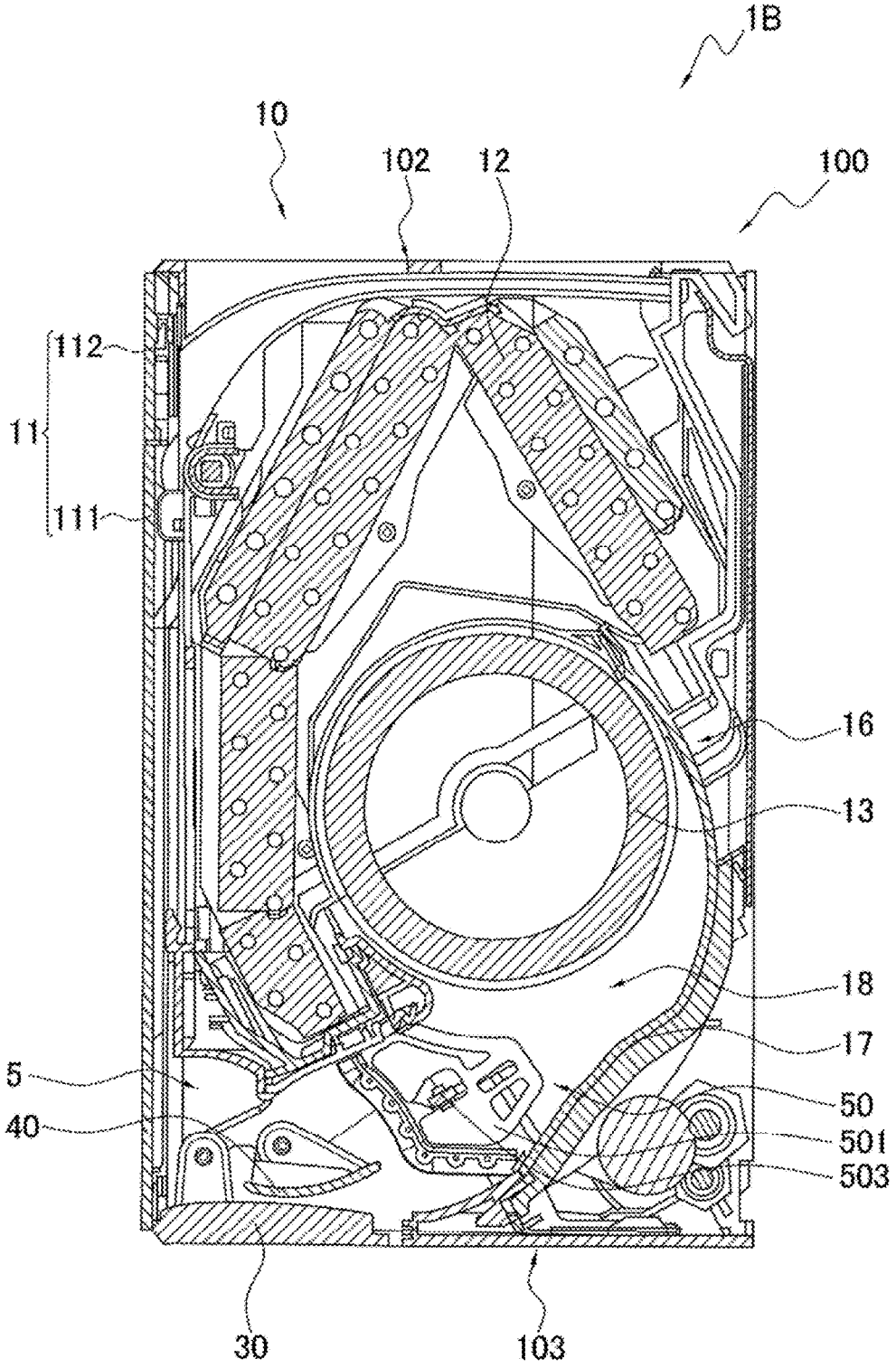
FIG. 17 is a longitudinal sectional view of an air conditioning indoor unit not in operation according to a modification example.
Figure 18:
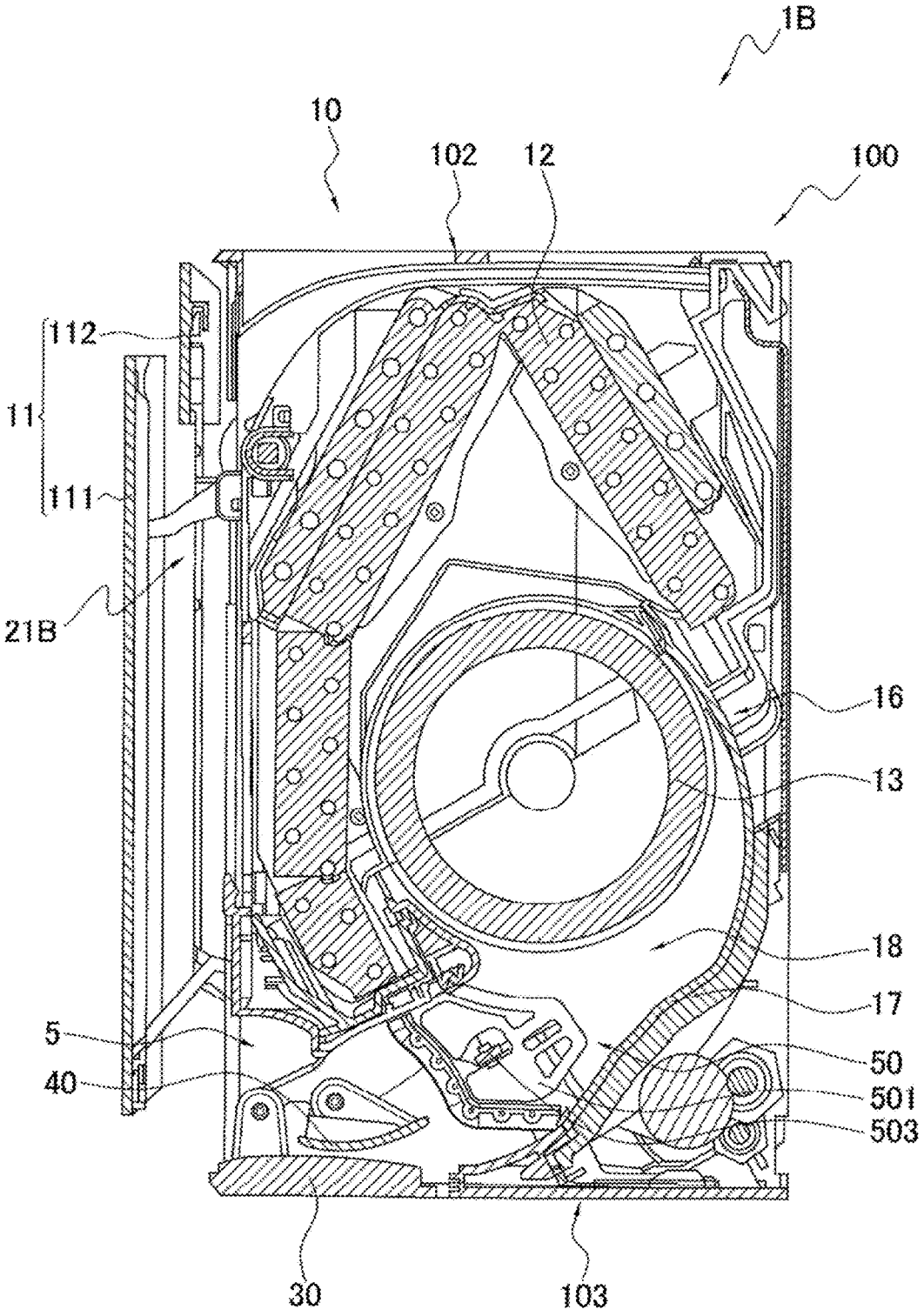
FIG. 18 is a longitudinal sectional view of the air conditioning indoor unit before starting operation according to the modification example, including a panel conveyance mechanism in operation.
Figure 19:
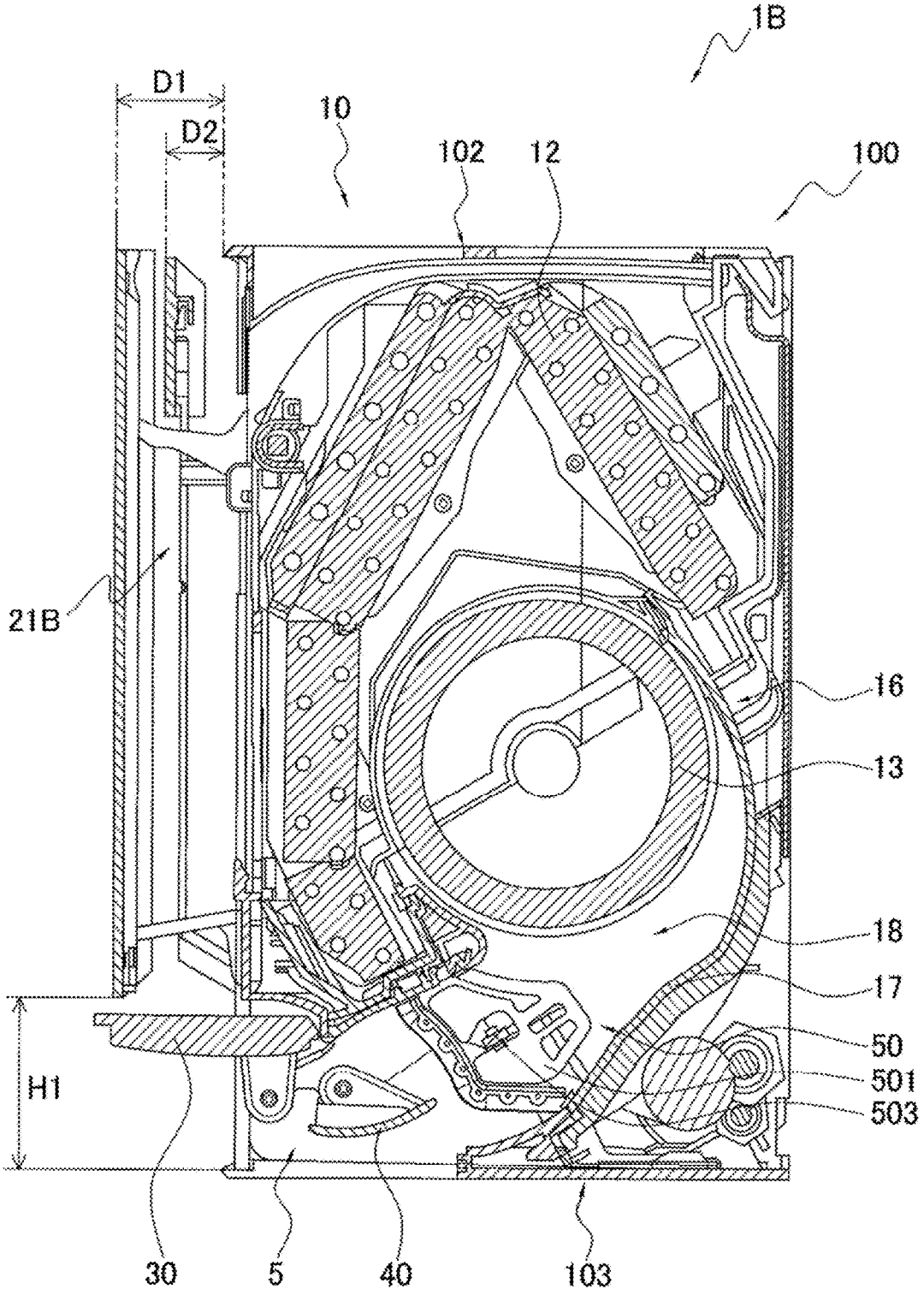
FIG. 19 is a longitudinal sectional view of the air conditioning indoor unit in operation according to the modification example.

FIG. 17 is a longitudinal sectional view of an air conditioning indoor unit 1B not in operation according to the modification example. FIG. 18 is a longitudinal sectional view of the air conditioning indoor unit 1B before starting operation, including a panel conveyance mechanism in operation. FIG. 19 is a longitudinal sectional view of the air conditioning indoor unit 1B in operation. As depicted in FIG. 17, FIG. 18, and FIG. 19, the air conditioning indoor unit 1B according to the modification example is different from the air conditioning indoor unit according to the above embodiment in that the air conditioning indoor unit 1B includes a panel conveyance mechanism 21B configured to convey both the first panel 111 and the second panel 112.

The panel conveyance mechanism 21B is obtained by adding a convey mechanism for the second panel 112 to the panel conveyance mechanism 21 configured to convey the first panel 111. As depicted in FIG. 18, the panel conveyance mechanism 21B initially shifts the first panel 111 forward and upward, and shifts the second panel 112 horizontally to be distant from the indoor unit body 10 when the first panel 111 is distant from the indoor unit body 10 by a predetermined distance.

Eventually, the first panel 111 stops after shifting horizontally by a distance D1 and vertically by a distance H1 from the indoor unit body 10 as depicted in FIG. 19. The second panel 112 stops after shifting horizontally from the indoor unit body 10 by a distance D2 shorter than the distance D1.

In the air conditioning indoor unit 1B in operation, the second panel 112 opens an upper front surface of the indoor unit body 10, and air passes between the upper front surface of the indoor unit body 10 and the second panel 112 to reach the front surface of the indoor unit body 10. This configuration shortens an air blow-in path from the front surface of the indoor unit body 10 to achieve reduction in air resistance.

(8) Characteristics (8-1)

The air conditioning indoor unit 1 includes the first panel 111 positioned in the lower portion and configured to shift to open the front end of the front blow-in port 4B. The first panel 111 and the second panel 112 are positioned inside the product contour in a front view, or are exposed slightly even when being exposed from the product contour. This configuration has less mounting restriction and achieves excellent appearance.

(8-2)

When the air conditioning indoor unit 1 is not in operation, the first panel 111 and the second panel 112 constitute the identical plane to achieve excellent appearance.

(8-3)

The front end of the blow-out port 5 is opened by simply shifting the lower first panel 111 with no need to shift two panels such as conventionally "shift the upper panel forward and then lift the lower panel", to achieve a simplified mechanism of the air conditioning indoor unit 1.

(8-4)

When the lower first panel 111 shifts to be positioned ahead of the upper second panel 112, the second panel 112 is hidden by the first panel 111 in a front view to achieve excellent appearance of the air conditioning indoor unit 1.

(8-5)

The vertical length of the upper second panel is at least equal to the height of the blow-out port in the air conditioning indoor unit 1, so that the front end of the blow-out port is opened if the first panel shifts to be positioned ahead of the second panel until the upper end of the first panel is leveled with the upper end of the second panel in a front view.

(8-6)

The vertical length of the lower first panel 111 is at least equal to the height of the blow-out port 5 in the air conditioning indoor unit 1, so that the front end of the blow-out port 5 is opened if the first panel 111 shifts to be positioned ahead of the second panel 112 until the upper end of the first panel 111 is leveled with the upper end of the second panel 112 in a front view.

(8-7)

The second panel 112 is entirely covered with the first panel 111 in a front view to achieve excellent appearance of the air conditioning indoor unit 1.

(8-8)

The first panel 111 shifts obliquely upward to quickly open the blow-out port 5 in the air conditioning indoor unit 1.

(8-9)

The upper end of the side surface 111*a* of the first panel 111 and the lower end of the side surface 112*a* of the second panel 112 face each other and are inclined forward and upward. The air conditioning indoor unit 1 accordingly prevents interference between the panels when the first panel 111 shifts obliquely upward.

(8-10)

The first crank 211 lifts the first panel 111 to be positioned above the second shaft 211*b* to shift the first panel 111 to be positioned in front of the second panel 112 in the air conditioning indoor unit 1.

(8-11)

When the first crank 211 lifts the first panel 111 to be positioned in front of the second panel 112, the first crank 211 approaches the lower end of the second panel 112 in the air conditioning indoor unit 1. The curved portion 211*c* curves to avoid the lower end of the second panel 112 so as to prevent interference between the first crank 211 and the lower end of the second panel 112.

INDUSTRIAL APPLICABILITY

The present invention is useful for a wall-hung air conditioning indoor unit as well as a floorstanding air conditioning indoor unit.

REFERENCE SIGNS LIST

1 air conditioning indoor unit
1B air conditioning indoor unit
10 indoor unit body
11 front panel
111 first panel
112 second panel
211 first crank
211*a* first shaft (connecting portion)
211*b* second shaft (shaft)
211*c* curved portion

CITATION LIST

Patent Literature

Patent Literature 1: JP 2005-98683 A

The invention claimed is:

1. An air conditioning indoor unit comprising:

a body casing having a front surface provided with a blow-in port;

a front panel covering the front surface of the body casing and configured to at least partially shift to open and close the blow-in port, wherein the front panel includes a first panel positioned at a lower side of the front panel and a second panel positioned above the first panel, when the air conditioning unit is not in operation, each of the first panel and the second panel hide respective portions of the front surface of the body casing when viewed from directly in front of the air conditioning indoor unit, the first panel shifts to be positioned in front of the second panel to open the blow-in port, each of the first panel and the second panel has a front external face that is substantially flat, and the air conditioning unit further comprises an arm configured to turn to shift the first panel to open the blow-in port, wherein the arm has a shaft provided directly behind the second panel such that the second panel covers the shaft in a front view.

2. The air conditioning indoor unit according to claim 1, wherein when the air conditioning indoor unit is not in operation, the first panel and the second panel have surfaces aligned on an identical vertical plane including the front surface of the body casing.

3. The air conditioning indoor unit according to claim 1, wherein the body casing has a lower portion provided with a blow-out port, and the first panel shifts to open at least part of the blow-out port.

4. The air conditioning indoor unit according to claim 1, wherein the first panel is vertically longer than the second panel in a front view.

5. The air conditioning indoor unit according to claim 1, wherein the body casing has a lower portion provided with a blow-out port, and the first panel has a vertical length set to be equal to or more than a height of the blow-out port.

6. The air conditioning indoor unit according to claim 1, wherein the body casing has a lower portion provided with a blow-out port, and the second panel has a vertical length set to be equal to or more than a height of the blow-out port.

7. The air conditioning indoor unit according to claim 1, wherein when the air conditioning indoor unit is in operation, the first panel ascends to have an upper end at least leveled with an upper end of the second panel in a front view.

8. The air conditioning indoor unit according to claim 1, wherein the first panel shifts obliquely upward.

9. The air conditioning indoor unit according to claim 1, wherein when the air conditioning indoor unit is not in operation, an edge at an upper end of the first panel and an edge at a lower end of the second panel face each other, each of said edges being inclined so that each of said edges have an upward slope moving from a rear of the front panel toward a front of the front panel when the air conditioning indoor unit is viewed from a peripheral side.

10. The air conditioning indoor unit according to claim 2, wherein the body casing has a lower portion provided with a blow-out port, and the first panel shifts to open at least part of the blow-out port.

11. The air conditioning indoor unit according to claim 1, further comprising:

an indoor unit body including the body casing having the front surface provided with the blow-in port.

12. The air conditioning indoor unit according to claim 11, wherein the arm has a connecting portion connected to the first panel, and the arm turns until the connecting portion is positioned in front of the second panel.

13. The air conditioning indoor unit according to claim 11, wherein when the air conditioning indoor unit is not in operation, the first panel and the second panel have surfaces aligned on an identical vertical plane including the front surface of the body casing.

14. The air conditioning indoor unit according to claim 11, wherein the indoor unit body has a lower portion provided with a blow-out port, and the first panel shifts to open at least part of the blow-out port.

15. The air conditioning indoor unit according to claim 11, wherein the first panel is vertically longer than the second panel in a front view.

16. The air conditioning indoor unit according to claim 11, wherein the indoor unit body has a lower portion provided with a blow-out port, and the first panel has a vertical length set to be equal to or more than a height of the blow-out port.

17. The air conditioning indoor unit according to claim 11, wherein the indoor unit body has a lower portion provided with a blow-out port, and the second panel has a vertical length set to be equal to or more than a height of the blow-out port.

18. The air conditioning indoor unit according to claim 11, wherein when the air conditioning indoor unit is in operation, the first panel ascends to have an upper end at least leveled with an upper end of the second panel in a front view.

19. The air conditioning indoor unit according to claim 11, wherein the first panel shifts obliquely upward.

20. The air conditioning indoor unit according to claim 11, wherein when the air conditioning indoor unit is not in operation, an edge of an upper end of the first panel and an edge of a lower end of the second panel face each other, each of said edges being inclined so that each of said edges have an upward slope moving from a rear of the front panel toward a front of the front panel when the air conditioning indoor unit is viewed from a peripheral side.

* * * * *